US008280264B2

(12) United States Patent
Inoue

(10) Patent No.: US 8,280,264 B2
(45) Date of Patent: Oct. 2, 2012

(54) TONER SUPPLY CONTAINER AND IMAGE FORMING APPARATUS, FOR DETECTING THE AMOUNT OF REMAINING TONER

(75) Inventor: Hiroshige Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1260 days.

(21) Appl. No.: 10/587,146

(22) PCT Filed: May 19, 2005

(86) PCT No.: PCT/JP2005/009592

§ 371 (c)(1),
(2), (4) Date: May 31, 2007

(87) PCT Pub. No.: WO2005/111734

PCT Pub. Date: Nov. 24, 2005

(65) Prior Publication Data

US 2008/0044204 A1 Feb. 21, 2008

(30) Foreign Application Priority Data

May 19, 2004 (JP) ..... 2004-149221

(51) Int. Cl.
*G03G 15/08* (2006.01)

(52) U.S. Cl. ..... 399/27; 399/262

(58) Field of Classification Search ..... 399/27, 399/30, 61, 119, 262
See application file for complete search history.

(56) References Cited

U.S. PATENT DOCUMENTS

| | | | | |
|---|---|---|---|---|
| 5,805,952 | A | 9/1998 | Buch et al. | 399/27 |
| 5,999,759 | A * | 12/1999 | Palumbo et al. | 399/27 |
| 6,256,459 | B1 | 7/2001 | Hasegawa et al. | 399/27 |
| 6,351,621 | B1 * | 2/2002 | Richards et al. | 399/111 |
| 6,385,407 | B1 * | 5/2002 | Inose | 399/24 |
| 6,505,007 | B2 | 1/2003 | Miura et al. | 399/27 |
| 2001/0026692 | A1 | 10/2001 | Miura et al. | 399/27 |
| 2003/0123889 | A1 | 7/2003 | Isobe et al. | 399/27 |
| 2005/0232646 | A1 | 10/2005 | Yoshizuka et al. | 399/27 |

FOREIGN PATENT DOCUMENTS

| | | |
|---|---|---|
| EP | 1 498 783 A1 | 1/2005 |
| JP | 6-3957 A | 1/1994 |
| JP | 10-221943 | 8/1998 |
| JP | 11-038755 A | 2/1999 |
| JP | 11-202609 | 7/1999 |
| JP | 2000-172058 | 6/2000 |
| JP | 2000-172059 | 6/2000 |

(Continued)

OTHER PUBLICATIONS

Office Action, dated Jan. 16, 2008, issued in Korean counterpart Patent Application No. 10-2006-7024079 and English-language translation thereof.

(Continued)

*Primary Examiner* — Sandra Brase
(74) *Attorney, Agent, or Firm* — Fitzpatrick, Cella, Harper & Scinto

(57) ABSTRACT

A toner supply container detachably mountable to an image forming apparatus, the toner supply container including a rotatable container body for containing toner; and a sensor, rotatable integrally with the container body, for detecting a remaining toner amount in the container body.

60 Claims, 32 Drawing Sheets

FOREIGN PATENT DOCUMENTS

| | | | |
|---|---|---|---|
| JP | 2000-231253 | | 8/2000 |
| JP | 2000-231254 | | 8/2000 |
| JP | 2003-76126 | A | 3/2003 |
| JP | 2003-202744 | A | 7/2003 |
| JP | 2003-270920 | A | 9/2003 |
| WO | WO 03/087953 | A1 | 10/2003 |

OTHER PUBLICATIONS

Office Action, dated Jun. 6, 2008, issued in Chinese counterpart Patent Application No. 200580015987.3 and English-language translation thereof.

Communication, dated Sep. 4, 2008, issued in European counterpart Patent Application No. 08158029.2-2209/1973009.

Office Action, dated Jul. 17, 2009, issued in Korean counterpart Patent Application No. 10-2009-7009338 and an English-language translation thereof.

Notification of the First Office Action issued Mar. 10, 2010, in counterpart Chinese Application No. 200910001416.4.

Communication issued Apr. 15, 2010, in counterpart European Application No. 05 743 636.2-2209.

Notification of Ground of Rejection mailed Aug. 25, 2009, in counterpart Japanese Application No. 2004-149221.

Notification of Ground of Rejection mailed Feb. 9, 2010, in counterpart Japanese Application No. 2004-149221.

* cited by examiner

TONER SUPPLY CONTAINER AND IMAGE FORMING APPARATUS, FOR DETECTING THE AMOUNT OF REMAINING TONER

TECHNICAL FIELD

The present invention relates to a toner supply container removably mountable in an image forming apparatus, for example, a copying machine, a printer, facsimile machine, etc., which employs the electrophotographic, electrostatic, or the like recording method. It also relates to an image forming apparatus compatible with such a toner supply container.

BACKGROUND OF THE INVENTION

It has been a common practice to use particulate toner as the developer for an electrophotographic image forming apparatus such as a copying machine or printer. As the toner in the main assembly of an image forming apparatus is consumed, the main assembly of the image forming apparatus is replenished with toner with the use of a toner supply container.

Generally, toner is in the form of extremely fine powder. Thus, one of the known methods for preventing toner from scattering during an operation for replenishing the main assembly of an image forming apparatus is to place a toner supply container in the main assembly of the image forming apparatus, and discharge toner little by little through the tiny opening of the toner supply container.

The toner replenishing apparatus, in accordance with the prior art, usable with the above described toner replenishing methods is structured so that the cap of the toner supply container can be removed by some kind of means, and some kind of driving force is transmitted to the toner supply container to drive the toner conveying member on the toner supply container side; or the toner supply container itself, which is given such a configuration that enables it to convey toner, is rotated to discharge the toner therefrom.

Also in the case of the toner replenishing apparatus in accordance with the prior art, by the time a user is forced to replace the replenishment toner container, the image forming apparatus will have been completely depleted of toner, by consumption.

Thus, Japanese Laid-open Patent Application 11-038755 discloses a method, shown in FIG. 35, for detecting the amount of toner remaining in a toner container.

This toner container 46*k* employs such a structural arrangement that as a spiral coil 46*b* disposed in the toner container 46*k* is rotated, the toner is conveyed and discharged.

A light sensor 900 solidly disposed on the main assembly side of the image forming apparatus is structured so that it projects a beam of light toward a light beam guiding member 901 of the replenishment toner container, and catches the beam of light reflected back by the light beam guiding member 901.

Thus, when there is toner in the replenishment toner container, the beam of light is blocked by the body of toner. Therefore, the beam of light does not return to the light sensor 901, indicating the presence of toner. On the other hand, if the beam of light returns to the light sensor 901, it is determined that there is no toner in the replenishment toner container.

Further, Japanese Laid-open Patent Application 11-038755 proposes to apply the above described toner remainder amount detecting method to a toner container, such as the one shown in FIG. 36, which is structured so that as the container itself is rotated, the toner in the container is conveyed and discharged.

More specifically, this replenishment toner container 46*k* is provided with spiral grooves, which are cut in the internal surface of the container. 46*k*, being extended from the rear end of the container 46*k*, in terms of the toner conveyance direction, to an opening 46*a* of the container 46*k*. Thus, as the replenishment toner container is rotated, the toner therein is discharged through the opening 46*a*, and falls into the hopper portion of the image forming apparatus. After falling into the hopper portion, the toner is conveyed toward the developing device by a screw 49*k* disposed in the hopper portion.

The structural arrangement disclosed in Japanese Laid-open Patent Application 11-038755, however, suffers from the following technical problems.

That is, the structural arrangement is such that the toner sensor 900 for detecting the amount of the toner remaining in the replenishment toner container is disposed on the main assembly side of the image forming apparatus, making it necessary to employ a toner sensor with a long service life, as the toner sensor 900. Further, the information regarding the amount of the toner remainder in the replenishment toner container can be obtained only in the binary fashion; in other words, only the information regarding whether or not the amount of the toner remaining in the replenishment toner container is more than a predetermined amount can be detected.

Thus, the employment of the above-described method for detecting the amount of the toner remainder was problematic in that it increased the cost of the image forming apparatus, and also, that it made the image forming apparatus complicated in structure. Further, in the case of the above-described method, a user was not informed of toner depletion until the replenishment toner container was completely depleted of the toner therein. Therefore, for a user who happened to have no replenishment toner container at hand, nothing was more inconvenient than being informed of the fact that the replenishment toner container in the image forming apparatus was completely depleted of the toner.

BRIEF SUMMARY OF THE INVENTION

The primary object of the present invention is to provide a replenishment toner container, the employment of which does not increase an image forming apparatus in cost, and does not complicate an image forming apparatus in structure.

Another object of the present invention is to provide a replenishment toner container, the amount of the toner remaining in which can be successively detected.

Another object of the present invention is to provide a replenishment toner container, the amount of the toner remaining in which can be precisely detected.

Another object of the present invention is to provide an image forming apparatus, the amount of the toner remaining in which can be successively detected.

Another object of the present invention is to provide an image forming apparatus, the amount of the toner remaining in which can be precisely detected.

These and other objects, features, and advantages of the present invention will become more apparent upon consideration of the following description of the preferred embodiments of the present invention, taken in conjunction with the accompanying drawings.

DETAILED DESCRIPTION OF THE INVENTION

Hereinafter, the preferred embodiments of the present invention will be described with reference to the appended drawings.

Embodiment 1

Figure 1:
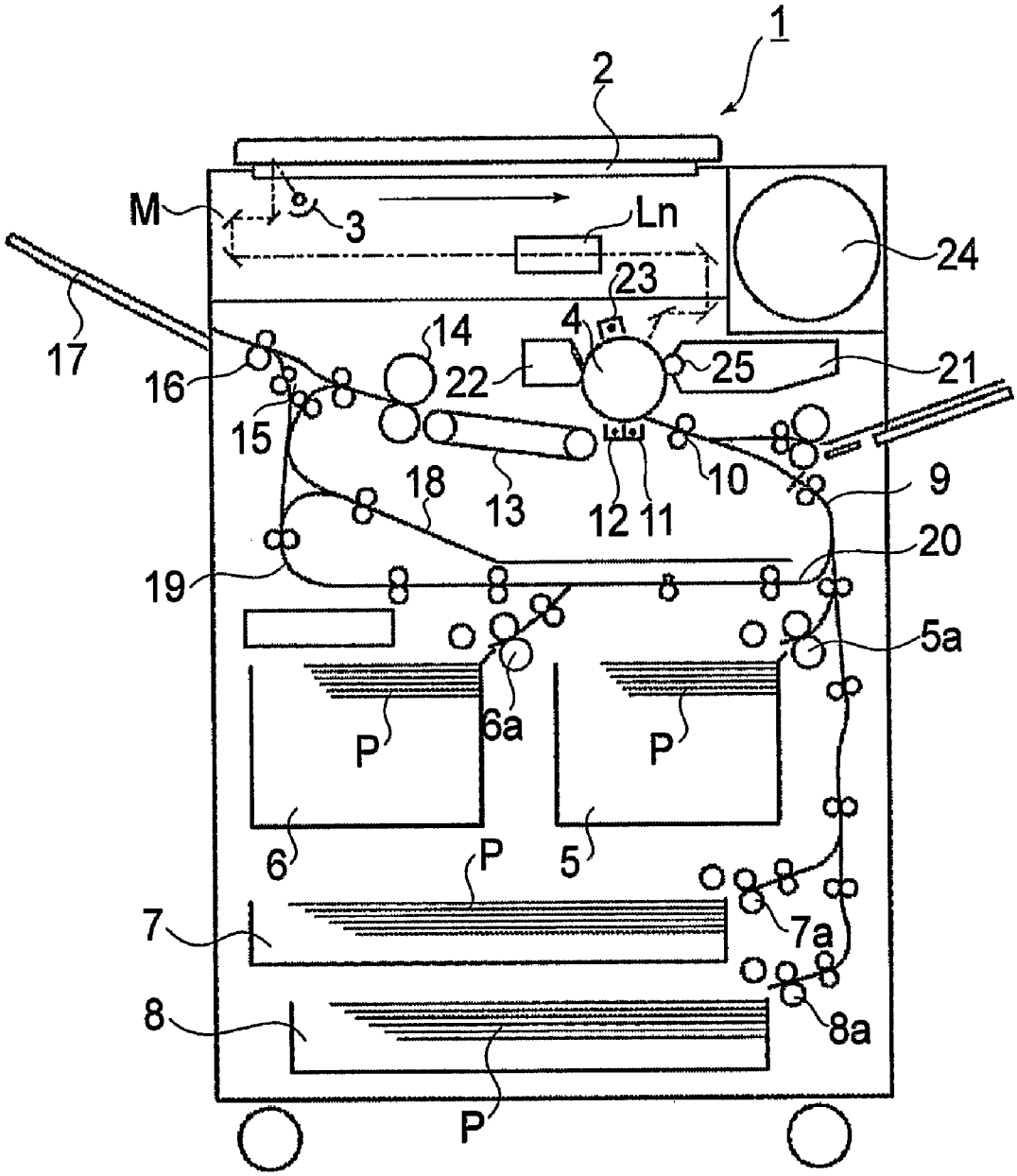
FIG. 1 is a schematic sectional view of a typical image forming apparatus according to the present invention, showing the general structure thereof.

FIG. 1 shows an example of an electrophotographic image forming apparatus employing a replenishment toner container in accordance with the present invention.

First, the general structure of the image forming apparatus will be described following the image formation sequence.

An original to be copied is placed on an original placement glass platen 2 which constitutes the topmost portion of the main assembly of the image forming apparatus 1. An optical image reflecting the image formation data of the original is formed on the peripheral surface of an electrophotographic photosensitive drum 4 as an image bearing member, by the combination of the plurality of mirrors M and a lens Ln, of an optical portion 3.

Figure 2:
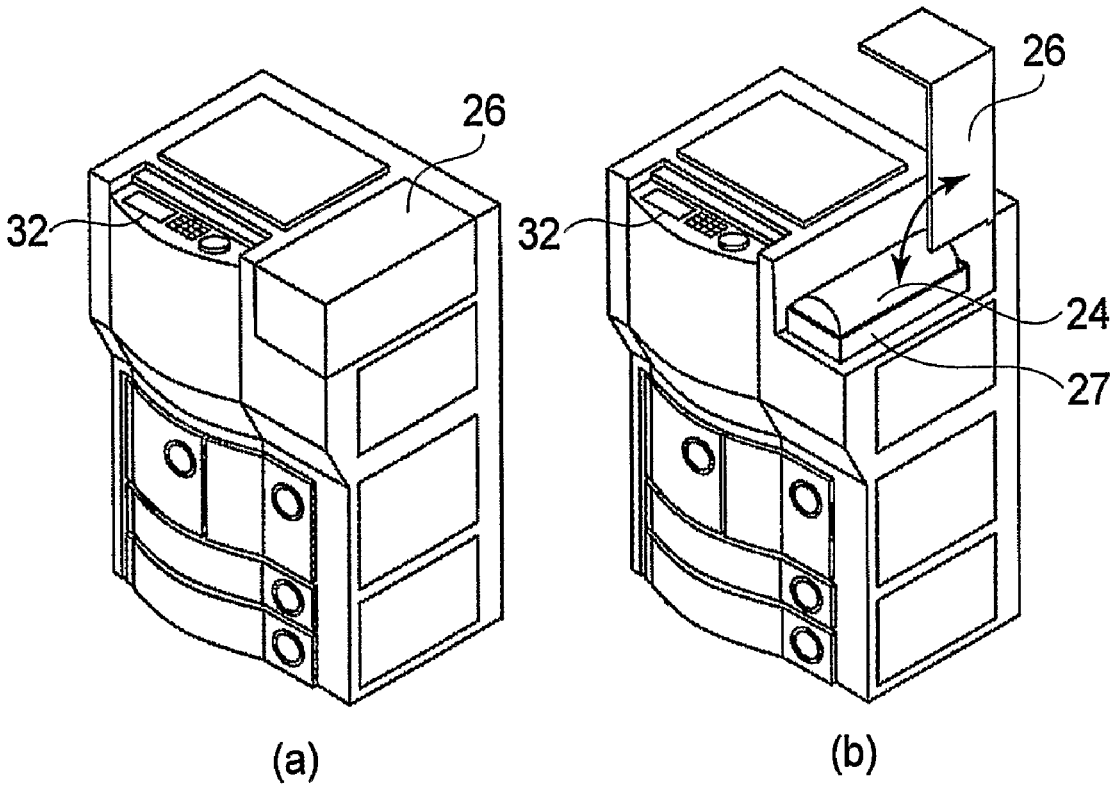
FIG. 2 is a schematic perspective view of the typical image forming apparatus in accordance with the present invention.

In the bottom portion of the main assembly of the image forming apparatus 1, a pair of paper feeder cassettes 5 and 6, and a pair of paper feeder decks 7 and 8 are disposed. From among these paper feeder cassettes 5 and 6, and paper feeder decks 7 and 8, the paper feeder cassette or paper feeder deck, which contains the sheets P most compatible with the information inputted by a user through a control panel 32 in the form of a liquid crystal display, shown in FIG. 2, which also functions as means for disseminating information, or the size of the unshown original, is selected based on the information regarding the sizes of the papers stored in the paper feeder cassettes 5 and 6, and paper feeder decks 7 and 8.

Then, the sheet of paper P (which hereinafter will be referred to simply as sheet P) is drawn out of the selected paper feeder cassette or deck, and fed into the main assembly of the image forming apparatus, by the function of a paper feeding/separating apparatus 5*a*, 6*a*, 7*a*, or 8*a*. Then, the sheet P is conveyed to a pair of registration rollers 10 through a paper conveyance path 9. Then, the sheet P is conveyed to a transferring portion by the pair of registration rollers 10, in synchronism with the rotation of the photosensitive drum 4 and scanning timing of the optical portion 3.

A toner image formed on the peripheral surface of the photosensitive drum 4 is transferred onto the sheet P by the transfer charging device 11 located in the transferring portion. Then, the sheet P onto which the toner image has just been transferred is separated from the photosensitive drum 4 by a separation charging device 12.

After being separated from the photosensitive drum 4, the sheet P is conveyed by a paper conveying portion 13 to a fixing portion 14, in which the toner image is permanently fixed to the sheet P by heat and pressure.

When the image forming apparatus 1 is in the single-sided image formation mode, the sheet P is conveyed through the discharging/reversing portion 15, and is discharged by a pair of discharge rollers 16 into a delivery tray 17.

On the other hand, when the image forming apparatus is in the two-sided image formation mode, a sheet conveyance direction switching member such as the unshown flapper or the like of the discharging/reversing portion 15 is switched in position. Thus, the sheet P is conveyed through the paper re-feeding paths 19 and 20, and then, to the pair of registration rollers 10. Then, the sheet P is conveyed through the same paper conveyance path as the paper path through which it was conveyed while the image on the sheet P was formed. While the sheet P is conveyed through the same path, another image is formed on the opposite surface of the sheet P from the surface which already has an image. Then, the sheet P is discharged into the delivery tray 17.

Further, when the image forming apparatus is in the so-called multilayer image formation mode, that is, the mode in which a plurality of image forming operations are carried out on the same surface of the sheet P, the sheet P is conveyed through the discharging/reversing portion 15. In this mode, however, the sheet P is not placed upside down by the paper reversing portion 18; in other words, the sheet P is conveyed to the pair of registration rollers 10 through the re-feeding paper conveyance paths 19 and 20, without being placed upside down, and then, is conveyed through the same paper conveyance path as the paper conveyance path through which it has just been conveyed during the preceding conveyance of the sheet P through the image forming apparatus. While the sheet P is conveyed through the same path, the next image is formed on the same surface of the sheet P as the surface on which an image was formed during the preceding conveyance of the sheet P through the image forming apparatus. Then, the sheet P is discharged into the delivery tray 17.

The image forming apparatus 1 structured as described above has the photosensitive drum 4, optical portion 3, developing device 21, cleaner 22, primary charging device 23, etc. The optical portion 3, developing device 21, cleaner 22, and primary charging device 23, etc., are disposed in the adjacencies of the peripheral surface of the photosensitive drum 4 in a manner to surround the photosensitive drum 4 in terms of the circumferential direction.

The primary charging device 23 is a device for uniformly charging the peripheral surface of the photosensitive drum 4 to a predetermined potential level.

The optical portion 3 forms an electrostatic latent image on the peripheral surface of the photosensitive drum 4, which has just been uniformly charged by the primary charging device 23, by exposing the uniformly charged peripheral surface of the photosensitive drum 4, in accordance with the image formation data extracted from the original.

The developing device 21 develops the electrostatic latent image on the peripheral surface of the photosensitive drum 4 by adhering toner, as developer, to the peripheral surface of the photosensitive drum 4 in the pattern of the latent image. The developing device 21 is structured so that as the toner in the developing device 21 is consumed, the developing device 21 is replenished with the toner from the replenishment toner container 24 (which hereinafter may be referred to simply as "toner bottle").

As for the structural arrangement for replenishing the developing device 21 with toner, any structural arrangement suffices as long as it makes it possible for a developing device, which uses two-component developer (which essentially is a mixture of nonmagnetic toner and magnetic carrier), to be replenished with not only the toner, but also, carrier, from the replenishment toner container.

In this embodiment, the image forming apparatus 1 and replenishment toner container are structured so that the latter is mounted into, or removed from, the former by a user.

Further, the developing device 21 is provided with a development roller 25 as a developer bearing member, a stirring member for stirring toner, and a conveying means for conveying toner toward the development roller 25, although the latter two are not shown in the drawing.

As the replenishment toner is sent from the toner bottle 24 into the developing device 21, it is further conveyed to the development roller 25 by the toner stirring member and toner conveying member. Then, it is supplied to the photosensitive drum 4 from the development roller 25.

The cleaner 22 removes or recovers the toner remaining on the peripheral surface of the photosensitive drum 4 after the transfer of a toner image onto the sheet P.

Next, referring to FIGS. 2(A) and 2(B), the operation for mounting the toner bottle 24 into the image forming apparatus 1 will be described.

The toner bottle 24 is set in the toner replenishing portion of the image forming apparatus 1. More specifically, first, a cover (door) 26 covering the toner bottle insertion opening located at the front of the main assembly of the image forming apparatus 1, in the top right-hand corner, is to be opened up and rearward of the main assembly. Then, the toner bottle 24 is to be placed in the bottle tray 27. Then, the cover 26 is to be closed to end the operation for mounting the toner bottle 24.

All that is necessary to be performed by a user to set the toner bottle in the toner bottle tray 24 is the above-described operation. Further, the operation for replacing the toner bottle 24 is similar to the above-described operation.

Next, referring to FIGS. 3(A) and 3(B), the structure of the toner bottle 24 will be described.

The toner bottle 24 comprises a bottle proper 28 as an actual storage portion in which toner is stored; a cap 29 as a sealing member for keeping sealed the toner outlet 24*a* of the bottle proper 28; and a toner conveying member 30 (which hereinafter will be referred to as baffle) which conveys the toner in the bottle proper 28 toward the toner outlet 24*a*.

The cap 29 comprises a coupling portion, which is attached to the cap 29 so that it can be moved to be coupled with a driving force transmitting member 33 (FIG. 4), which constitutes the driving force transmitting portion of the toner replenishing apparatus. The toner bottle 24 receives the rotational driving force from the image forming apparatus 1 only when this coupling portion of the cap 29 is in engagement with the driving force transmitting member 33 of the main assembly. As the toner bottle 24 receives the driving force, it rotates with the baffle 30.

More specifically, the bottle proper 28 is provided with the toner outlet 24*a*, which is attached to the one of the end walls of the bottle proper 28. Further, the bottle proper 28 is provided with a drive shaft 47, which is integral with the bottle proper 28, and extends outward through the toner outlet 24*a*.

The axial line of the driving shaft 47 roughly coincides with that of the toner outlet 24*a*. The drive shaft 47 is fitted in the connective hole 29*a* of the cap 29. The drive shaft 47 is for transmitting the rotational driving force from the driving force transmitting member 33 to the bottle proper 28 through the cap 29. Thus, it is given a cross section in the form of a rectangle (inclusive of square), H, D, or the like shape, in order to enable it to transmit the rotational driving force. Further, the connective hole 29*a* is given the cross section which matches that of the drive shaft 47.

In this embodiment, as will be evident from the above description of the structure of the toner bottle 24, it does not occur that when the toner bottle 24 is in the image forming apparatus 1, the baffle 30 alone is rotated. That is, the toner bottle 24 is structured so that the bottle proper 28, cap 29, and baffle 30 rotate together, whenever they rotate.

As the bottle proper 28 of the toner bottle 24 is rotated, the toner in the toner bottle 24 is conveyed to the toner outlet 24*a* of the toner bottle 24 by the tilted plates 31 of the baffle, being eventually discharged toward the toner replenishing apparatus.

Figure 3:
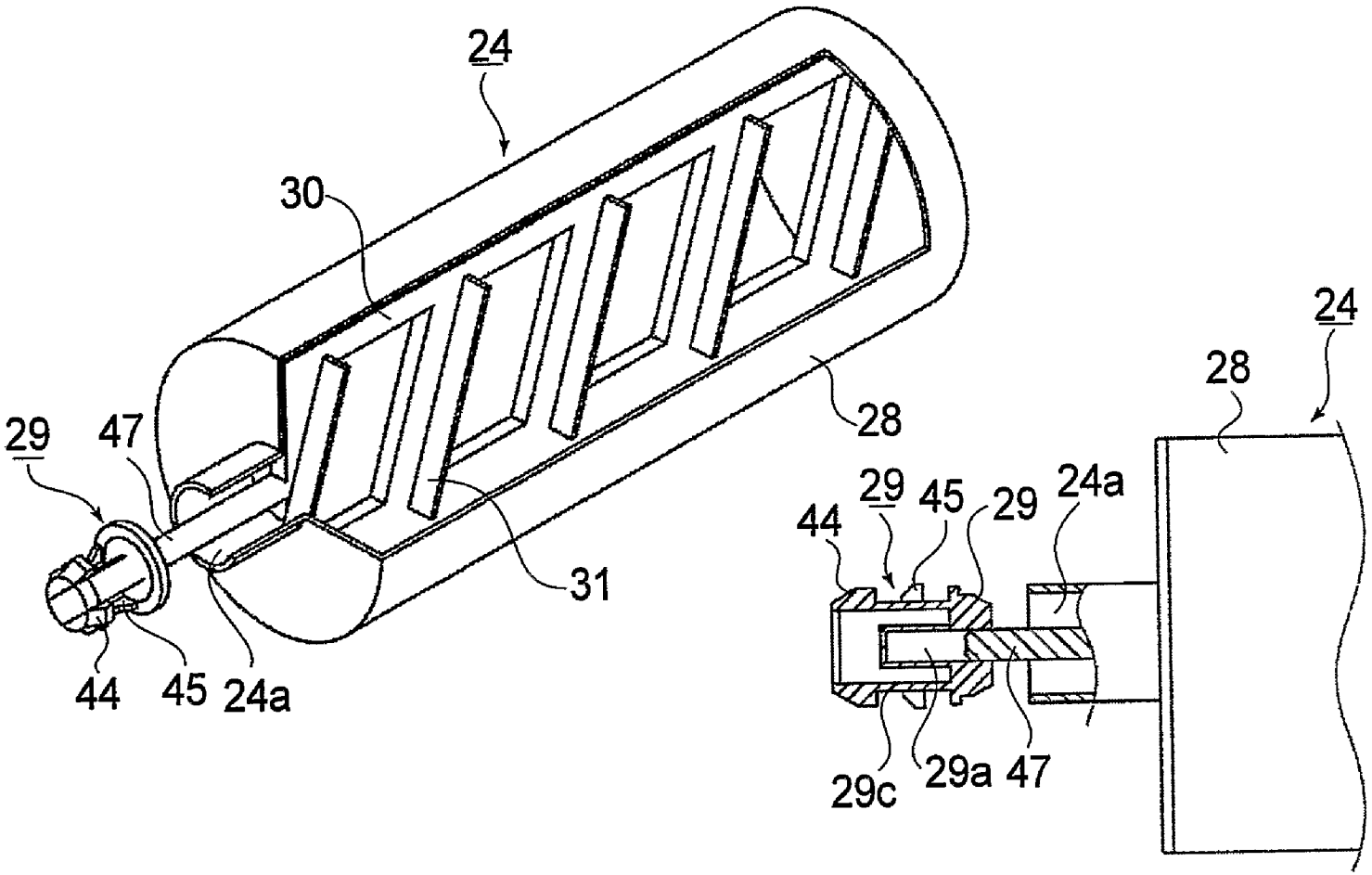
FIG. 3, at the right side, is a schematic perspective cutaway view of the toner bottle to be mounted in the image forming apparatus according to the present invention, and at the left side, is a schematic sectional view of the toner outlet portion and cap of the toner bottle, showing the relationship thereof.

Next, referring to FIGS. 3-5, the cap 29 as a sealing member, and a cap coupling member 33 as the aforementioned driving force transmitting member which transmits the driving force to the cap 29, will be described regarding their structures.

The cap 29 comprises: a sealing portion 29*b* which can be removably fitted into the toner outlet 24*a* of the toner bottle 24 to seal or unseal the toner outlet 24*a*; and a cylindrical coupling portion 29*c* which engages with the cap coupling portion 33.

The cylindrical coupling portion 29*c* comprises a plurality of identical portions distributed with equal gaps in terms of the circumferential direction of the coupling portion 29*c*. In this embodiment, it has six identical portions, and every other portion is provided with a locking projection 44 which engages with the cap coupling member 33, and a releasing projection 45 for disengaging the locking projection from the cap coupling member 33.

The cap 29 is desired to be manufactured of elastically deformable plastic by injection molding. As the material therefor, low density polyethylene is most preferable, although polypropylene, straight chain polyamide, for example, Nylon (commercial name), high density polyethylene, polyethylene, ABS, HIPS (impact-resistant polystyrene, and the like), are also preferably usable as the second choices to the low density polyethylene.

As for the cap coupling member 33, it comprises a plurality (two in this embodiment) of locking holes 46*c* into which the locking projections 44 of the cap 29 lock, one for one; and a hooking portion 46*a* which hooks the locking projections 44, in terms of the direction indicated by an arrow mark A; and a plurality (two in this embodiment) of ribs 46*b* which connect the hooking portion 46*a* to the main portion of the cap coupling member 33.

As the cap coupling member 33 is rotated by the rotational driving force from the main assembly of the image forming apparatus 1 after the locking projections 44 of the cap 29 lock into the locking holes 46*c* of the cap coupling member 33, each of the ribs 46*b* hooks one of the locking projections 44, in terms of the rotational direction of the cap coupling member 33, transmitting thereby the driving force to the cap 29.

The width of each of the locking holes 46*c*, in terms of the circumferential direction of the cap coupling member 33, is rendered substantially greater than that of each of the locking projections 44 in terms of the circumferential direction of the cap 29, making it virtually unnecessary to align in rotational phase the locking holes 46*c* with the locking projections 44 when mounting the toner bottle 24 into the main assembly of the image forming apparatus 1.

Next, it will be described how the cap 29, as the member for keeping the toner bottle 24 sealed, is moved in the direction to unseal or seal the toner bottle 24.

Figure 4:
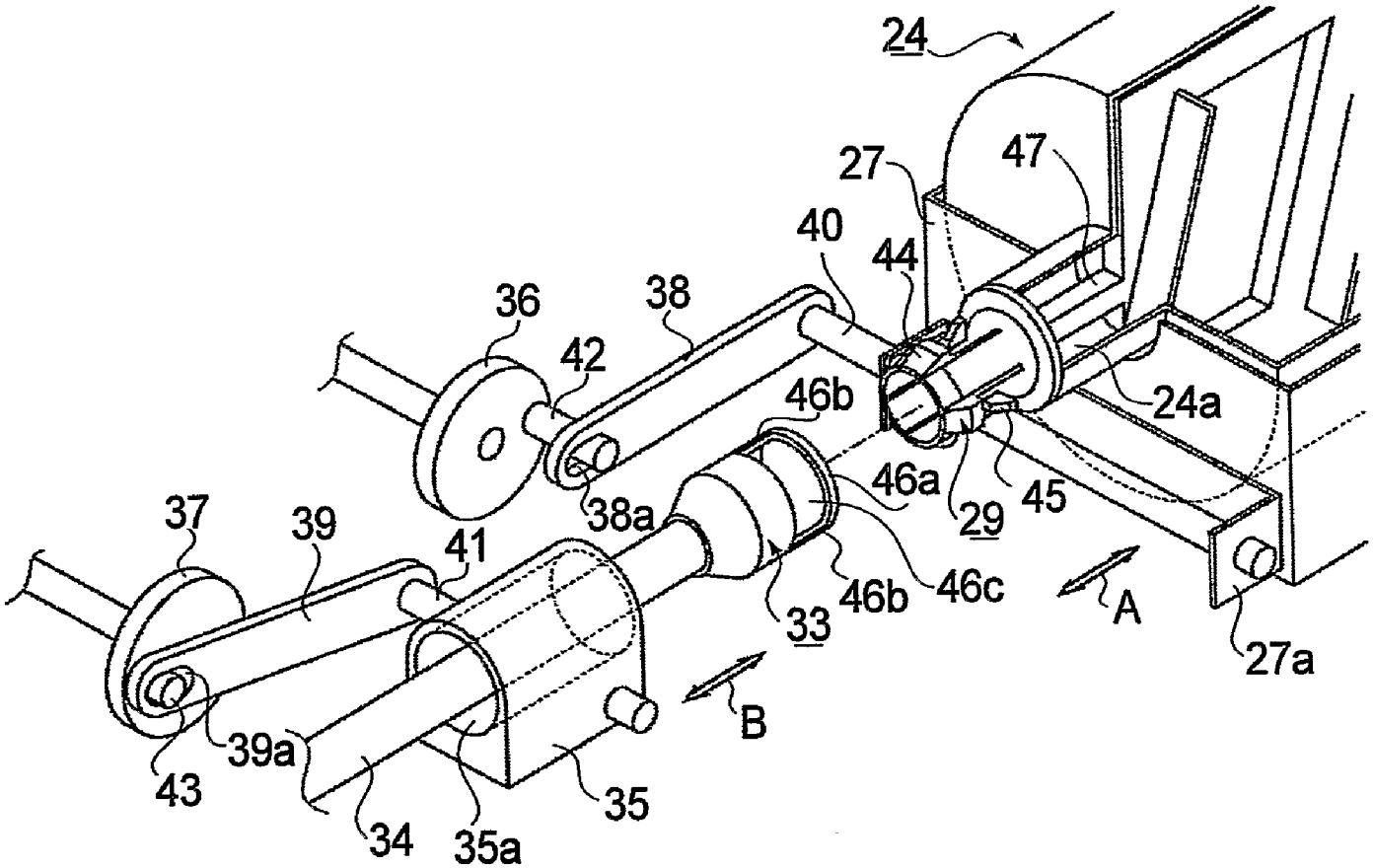
FIG. 4 is a schematic perspective view of the toner replenishing apparatus according to the present invention, showing the general structure thereof.

FIG. 4 is a schematic perspective view of the mechanism for moving the cap 29 in the direction to seal or unseal the bottle proper 28, and also, for rotating the bottle proper 28, and shows the general structure thereof.

In this embodiment, to the bottle tray 27 in which the toner bottle 24 is to be mounted, an angled member 27*a* is fixed, to which a connective shaft 40 is rotatably attached. To one end of the connective shaft 40, one end of the crank 38 is connected, whereas the other end of the crank 38 is connected to an eccentric shaft 42 with which a rotational disc 36 is provided.

Thus, as the rotational disc 36 is rotated, the bottle tray 27 is made to shuttle in the direction indicated by a double-headed arrow mark A in FIG. 4. As the bottle tray 27 is moved toward the cap coupling member 33 and reaches the point from which it is made to shuttle backward, the cap 29 of the toner bottle 24 couples with the cap coupling member 33 as the driving force transmitting member, which constitutes the driving force transmitting portion of the toner replenishing apparatus of the main assembly of the image forming apparatus 1.

Figure 5:
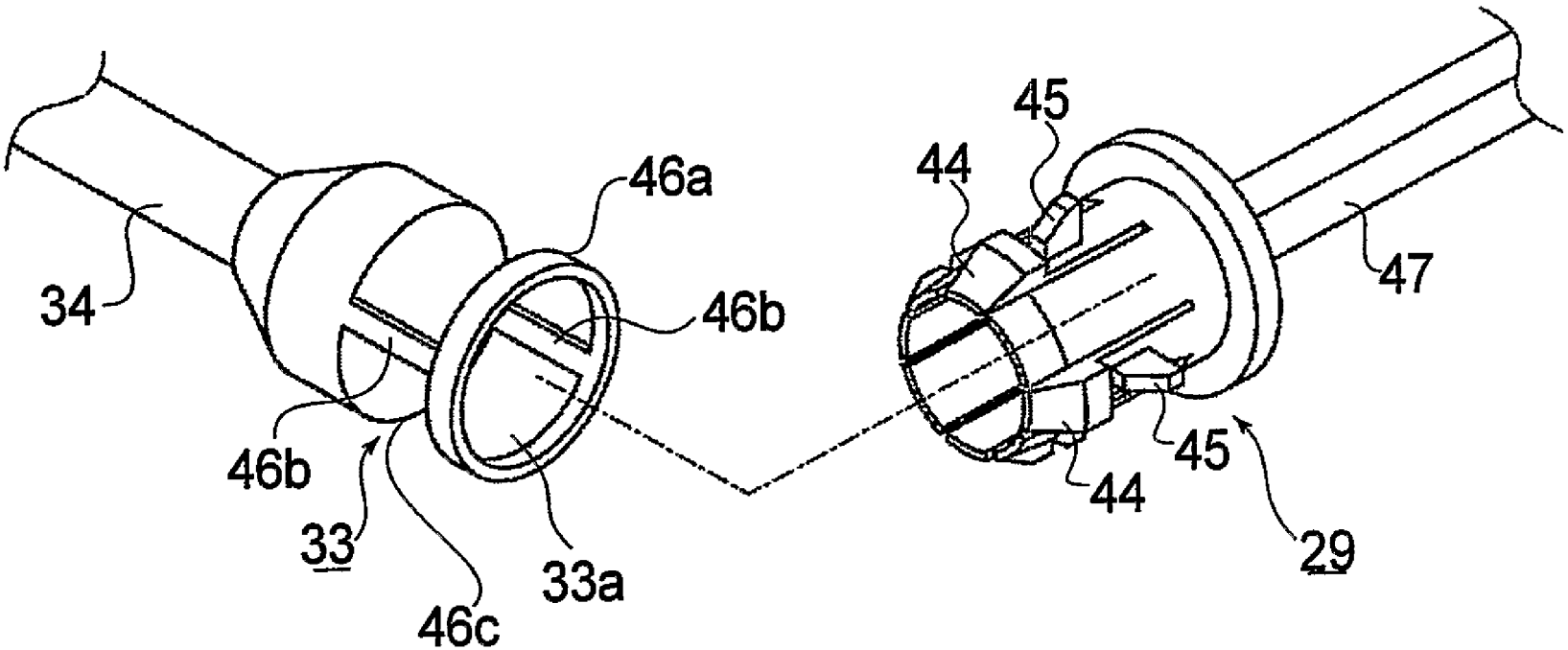
FIG. 5 is a schematic perspective view of the cap portion of the toner bottle, and the cap coupling member of the toner replenishing apparatus.

More specifically, as will be better understood with reference to FIG. 5 in addition to FIG. 4, the end of the cap 29 is inserted into the hollow 33*a* of the cap coupling member 33, causing the locking projections 44 of the cap 29 to lock into the locking holes 46*c* of the cap coupling member 33. As a result, the locking projections 44 are hooked by the hooking portion 46*a*.

As soon as the cap 29 becomes fully coupled with the cap coupling member 33, the bottle tray 27 is made to move backward, that is, in the direction to move away from the cap coupling member 33. As a result, the cap 29 with which the toner outlet 24*a* of the toner bottle 24 has been kept sealed is displaced a predetermined distance in the direction to move away from the bottle proper 28, allowing the toner in the toner bottle 24 to be discharged.

With the toner bottle 24 being in the above-described state, the cap coupling member 33, which also functions as the driving force transmitting means, is rotated, rotating thereby the toner bottle 24. As the toner bottle 24 is rotated, the toner in the toner bottle 24 is discharged through the toner outlet 24*a* by the combination of the baffle 30 and tilted plates 31 in the toner bottle 24.

Incidentally, even when the cap 29 is in the position in which it leaves the toner bottle 24 unsealed, the cap 29 remains connected to the baffle 30 and tilted plates 31 in the toner bottle 24, and therefore, the driving force is transmitted to the toner bottle 24 from the cap 29.

To describe in more detail the manner in which the cap 29 is attached to the toner bottle 24 to ensure the driving force is transmitted from the cap 29 to the toner bottle 24, as described before, the drive shaft 47 is given the rectangular (inclusive of square) cross section, and the cap 29 is given the connective hole 29*a*, the cross section of which matches that of the drive shaft 47 in cross section, and the axial line of which coincides with that of the drive shaft 40. Further, the drive shaft 47 is fitted in the center hole 29*a* so that the cap 29 is allowed to freely slide on the drive shaft 47 in the direction parallel to the axial line of the cap 29 (axial line of drive shaft 47). However, the manner in which the cap 29 is attached to the toner bottle 24 does not need to be limited to the above-described one.

Figure 6:
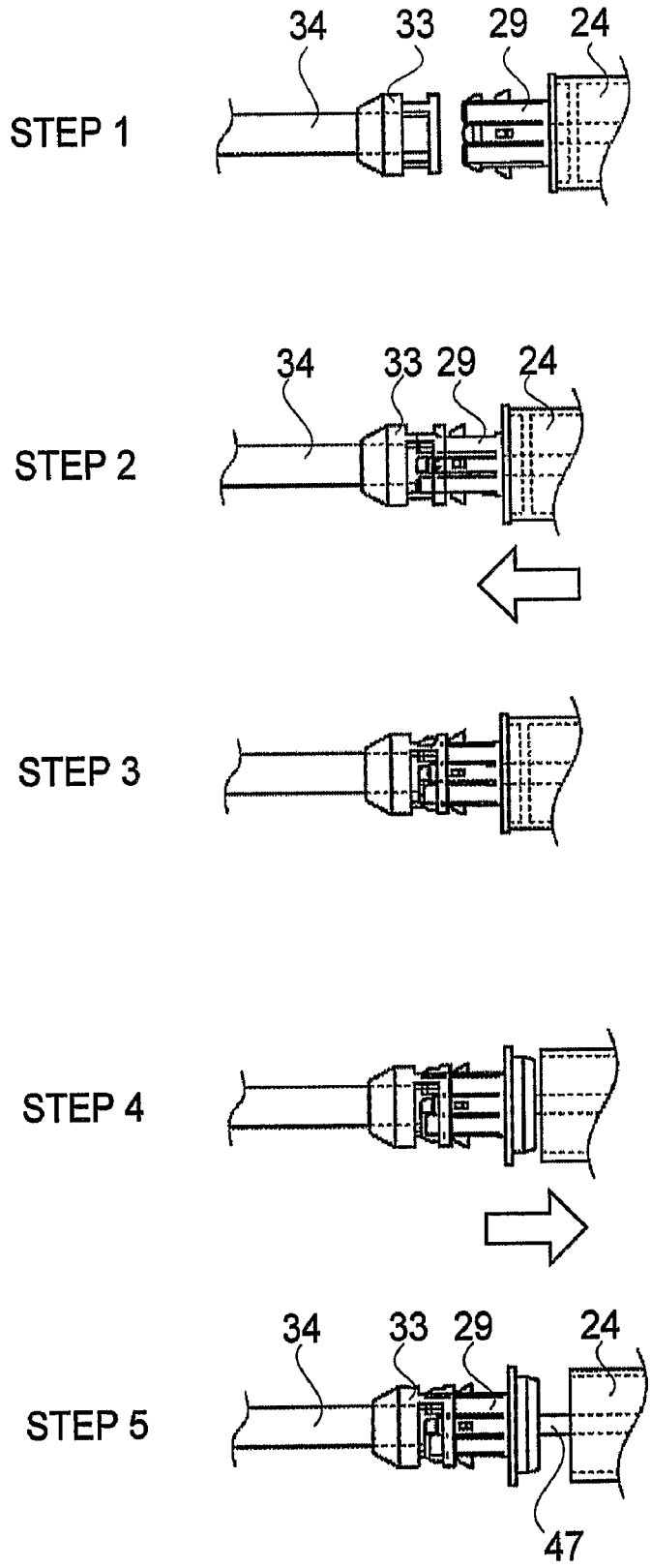
FIG. 6 is a drawing for describing the sequential steps through which the cap of the toner bottle is removed.

Next, referring to FIG. 6, the above described sequential movements of the cap 29, toner bottle 24, toner bottle tray 27, etc., will be summarized.

In Step 1, the toner bottle 24 is set in the bottle tray 27 so that its lengthwise direction becomes roughly horizontal.

In Step 2, the toner bottle 24 is moved in the direction indicated by an arrow mark. In the drawing, the leading end of the cap 29, in terms of the direction in which the toner bottle 24 is moved, has just begun to enter the recess of the cap coupling member 31.

In Step 3, the toner bottle 24 is moved to the point from which the toner bottle 24 is caused to shuttle back. The drawing shows that the cap 29 has fully coupled with the cap coupling member 33.

In Step 4, the toner bottle 24 is moved back to its initial position. The drawing shows that the toner bottle 24 is being returned in the direction indicated by an arrow mark, that is, the direction to be moved away from the cap coupling member 33, with the cap 29 remaining coupled with the cap coupling member 33, causing thereby the toner outlet 24*a*, which previously remained sealed, to become unsealed, making it thereby possible for the toner to be discharged.

In Step 5, the process of unsealing the toner bottle 24 is completed. The drawing shows that the process has been completed, and the driving force is being transmitted from the driving force transmitting shaft 34 to toner bottle 24, rotating thereby the toner bottle 24 to discharge the toner in the toner bottle 24 into the toner replenishing apparatus.

Next, the uncoupling of the cap 29 from the cap coupling member 33 will be described.

Referring to FIG. 4, in this embodiment, the cap releasing member 35 is disposed on the opposite side of the cap coupling member 33 from the cap 29. The cap releasing member 35 is provided with a cylindrical hole 35*a*, through which the cap coupling member 33, and the drive shaft 34 of the cap coupling member 33, are put.

Also referring to FIG. 4, in this embodiment, the cap releasing member 35 is structured similarly to the structure which causes the toner bottle tray 27 to shuttle. In other words, one end of a crank 39 is connected to the connective shaft 41 of the cap releasing member 35, and the other end of the crank 39 is connected to the eccentric shaft 43 of a rotational disk 37. Thus, as the rotational disc 37 is rotated, the cap releasing member 35 is made to shuttle.

As the cap releasing member 35 is moved close to the point (turning point) at which the cap releasing member 35 switches its moving direction and begins to move away from the toner bottle 24, the cap 29, which is remaining coupled with the cap coupling member 33, is caused to enter the hole 35*a* of the cap releasing member 35, and as the cap releasing member 35 reaches this turning point, the cap 29 entirely fits into the cap releasing member 35.

Thus, the cap releasing projections 45 of the cap 29 are kept pressed toward the axial line of the cap 29, by the internal surface of the cylindrical hole 35*a*. As a result, the locking projections 44 of the cap 29 become unhooked from the hooking portion 46*a*, making it possible for the cap 29 to be uncoupled from the cap coupling member 33.

Figure 7:
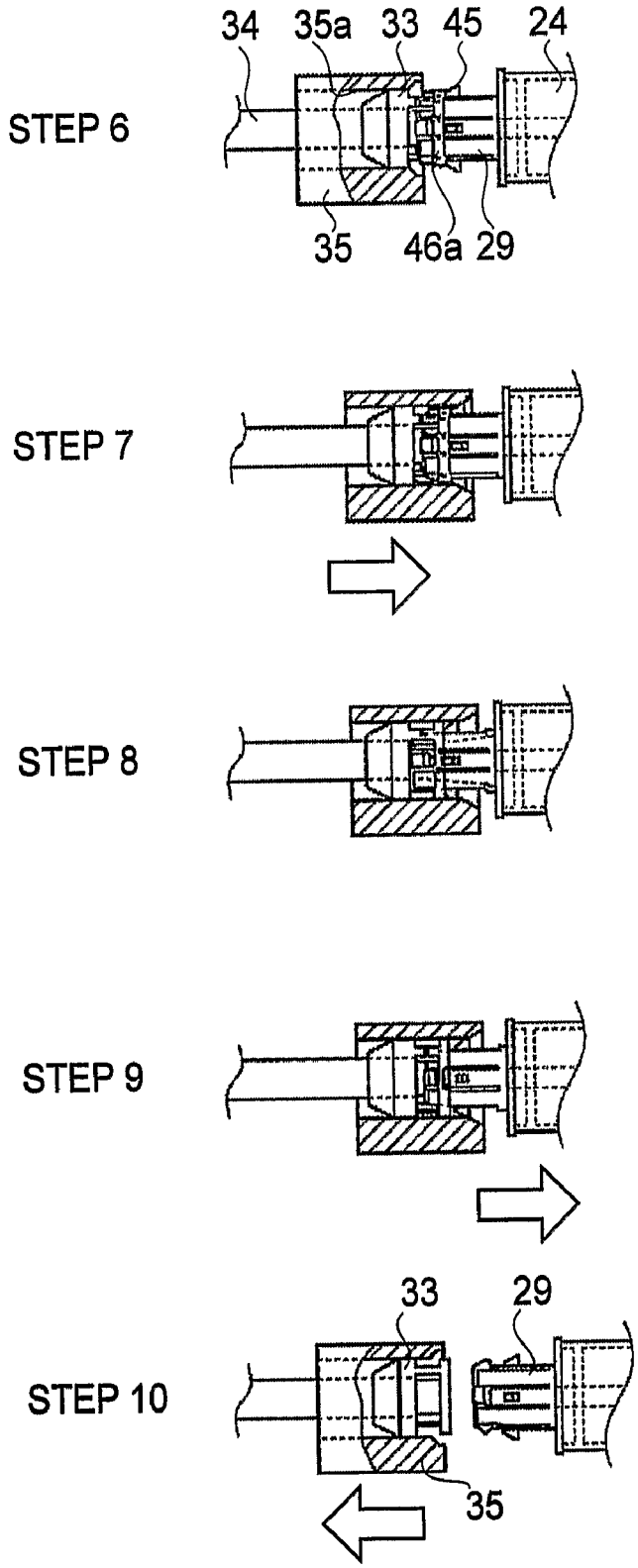
FIG. 7 is a drawing for describing the sequential steps through which the cap of the toner bottle is reattached.

The following summarizes the above described sequence of uncoupling the cap 29 with reference to FIG. 7.

In Step 6, the cap 29 is remaining coupled with the cap coupling member 33.

In Step 7, the cap releasing member 35 is moved in the direction indicated by an arrow mark. The drawing shows that the cap releasing member 35 is being moved in the direction indicated by the arrow mark, that is, the direction in which it is to be moved to uncouple the cap coupling member 33 from the cap 29, with the joint between the cap coupling member 33 and cap 29 being forced into the cylindrical hole 35*a* of the cap releasing member 35.

In Step 8, the locking projections 44 of the cap 29 are unhooked from the hooking portion 46*a* of the cap coupling member 33. The drawing shows that with the insertion of the above-mentioned joint into the cylindrical hole 35*a* to a predetermined point therein having just been completed, the cap releasing projections 45 of the cap 29 have just been moved toward the axial line of the cylindrical hole 35*a*, by the internal surface of the hole 35*a*, unhooking thereby the locking projections 44 of the cap 29 from the hooking portion 46*a* of the cap coupling member 33.

In Step 9, the toner bottle 24 is moved away from the cap coupling member 33 in the direction indicated by an arrow mark.

In Step 10, the cap releasing member 35 is moved in the direction indicated by an arrow mark to be returned to its home position, making it possible for the toner bottle 24 to be removed from the image forming apparatus 1.

It is not problematic that the rotational disks 36 and 37 for causing the toner bottle 24 and cap releasing member 35 to shuttle are individually driven with the use of two driving force sources, one for one. In the case of the image forming apparatus in this embodiment, however, the pivotal movement of the cover 26 resulting from the opening or closing of the cover 26 is utilized as the power source for rotating the disks 36 and 37. In other words, the cover 26 is mechanically linked to the toner bottle tray 27 and cap releasing member 35 so that as the cover 26 is opened or closed, the toner bottle 24 and cap releasing member 35 are made to shuttle.

Incidentally, the above-described mechanism for conveying the toner in the toner bottle, mechanism for receiving the rotational driving force, and mechanism for pressing the cap 29 into the toner outlet 24*a* or partially extracting the cap 29 from the toner outlet 24*a*, are only examples of such mechanisms. Obviously, any of the various known mechanisms other than the above described ones may be employed.

For example, the internal surface of the cylindrical wall of the bottle proper 28 of the toner bottle 24 may be provided with a plurality (inclusive of single) of spiral grooves as a toner conveying mechanism, so that as the toner bottle 24 is rotated, the toner is conveyed toward the toner outlet 24*a* by the grooves.

As for an example of the mechanism for receiving the rotational driving force, the external surface of the cylindrical wall of the toner bottle 24 may be provided with a plurality of teeth aligned in the circumferential direction so that they are enabled to mesh with the counterpart of the driving force transmitting mechanism on the main assembly side to receive the rotational driving force through them.

As for another example of the mechanism for moving the cap 29 to unseal or seal the toner bottle 24, the main assembly of the image forming apparatus 1 may be provided with such a mechanism that moves a cap coupling member 33 to the cap 29, and pulls out the cap 29 to unseal the toner outlet 24*a*, while the toner bottle 24 is kept stationary.

Next, referring to FIGS. 8-12, the gist of the structural arrangement for detecting the amount of the toner remainder in the toner bottle 24 will be described.

As for the method for detecting the amount of the toner remaining in the toner bottle 24, when magnetic toner is used, one of the toner remainder amount detecting methods of the magnetic permeability detection type, magnetic detection type, piezoelectric vibration detection type, light transmission detection type, and the like can be preferably used, whereas when nonmagnetic toner is used, the toner remainder amount detecting method of the piezoelectric vibration detection type, and light transmission detection type, can be preferably used, because magnetism cannot be utilized for the detection. Further, the structural arrangement in which a thin switch or pressure sensor is used for toner remainder detection can also be preferably used.

As one of the preferable thin pressure sensors, a membrane switch is available. A membrane switch is a thin switch used in the control panel of a home appliance or office automation device. It is made up of a plurality of pieces of film, which have electrodes printed thereon with the use of electrically conductive ink, and which are placed in layers.

A substantial number of membrane switches are of the binary output type. However, some of them are devised in electrode (electrodes are printed with pressure sensitive ink or the like) so that their electrodes change in electrical resistance in response to the pressure applied thereto. The latter can also be preferably used as the pressure sensor.

This type of membrane switch is most suitable as the thin pressure sensor used in this embodiment. When it is desired to dispose a plurality of pressure sensors at a high density, it is desired to use thin pressure sensors based on the MEMS technology.

Incidentally, "MEMS" is the abbreviation of "micro electro mechanical system". It is one of the technologies for forming a combination of a microscopic mechanical structure and electric circuitry on a tiny piece of substrate, with the use of the exposure process used for the manufacturing of a semiconductor.

With the use of MEMS, it is possible to dispose a plurality of thin microscopic pressure sensors across the area of a limited size, at a high density and with extremely low cost, which has been impossible in the past.

Figure 34:
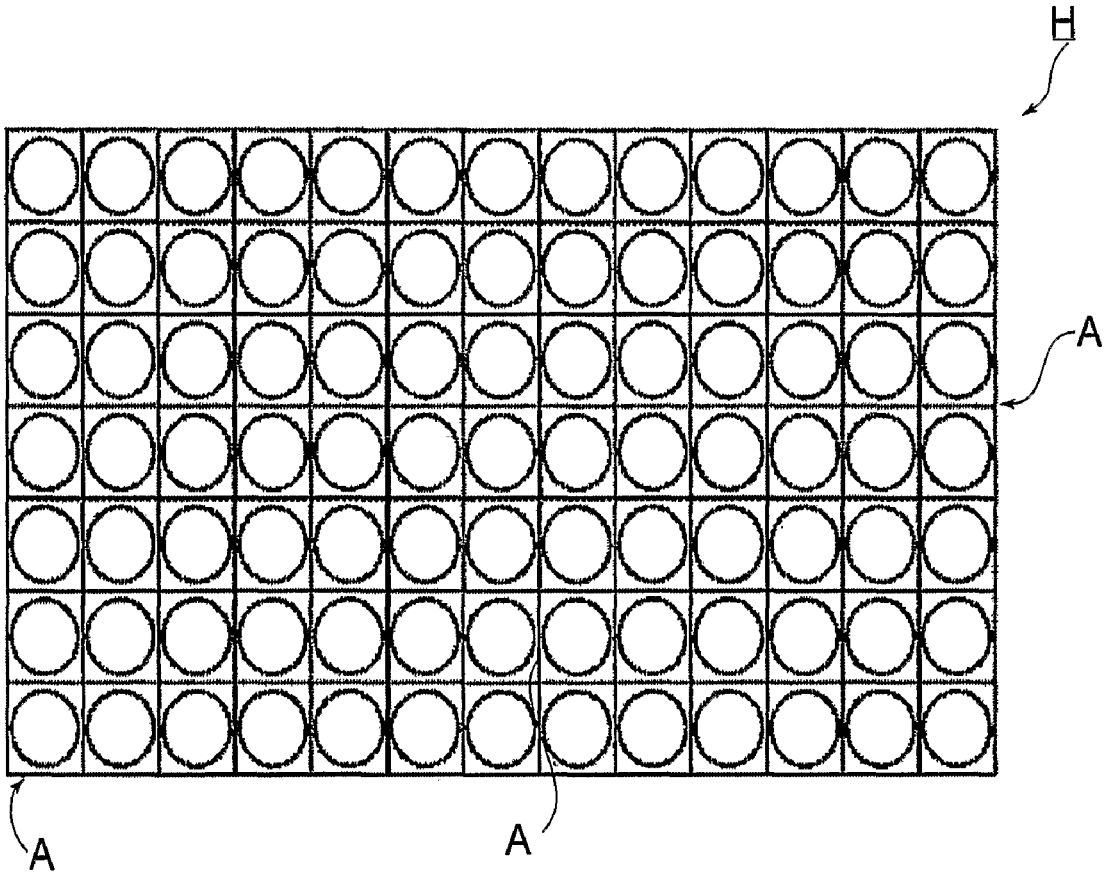
FIG. 34 is a schematic plan view of the pressure sensors based on the MEMS technology.
Figure 35:
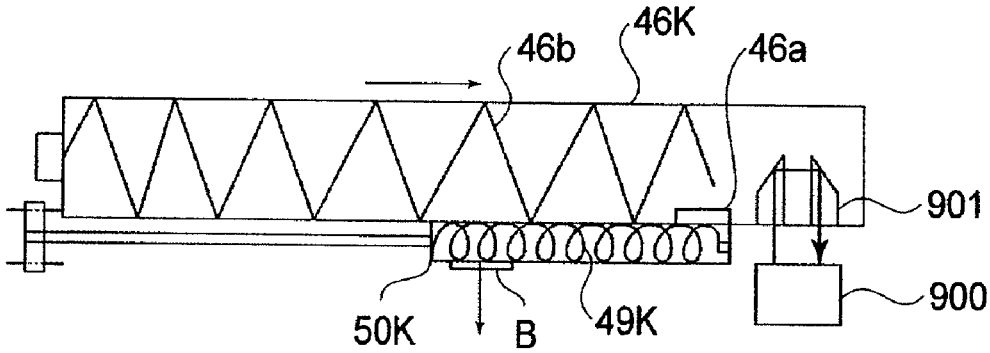
FIG.35 PRIOR ART
FIG. 35 is a schematic sectional view of one of the replenishment toner containers in accordance with the prior art.
Figure 36:
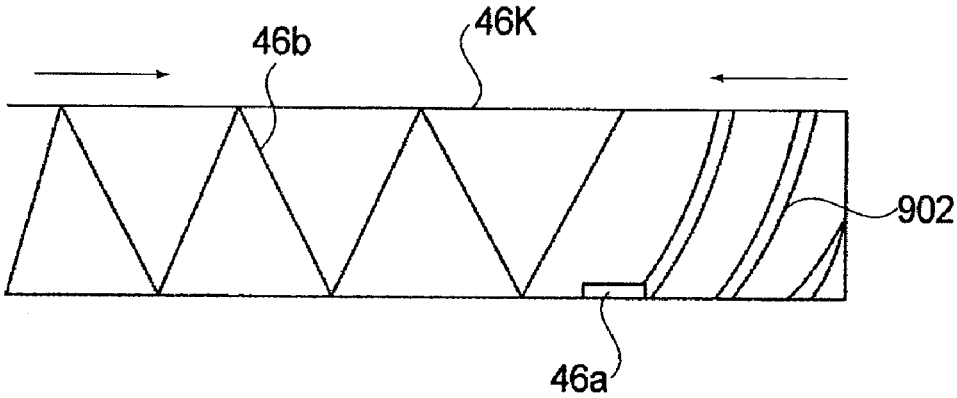
FIG.36 PRIOR ART
FIG. 36 is a schematic sectional view of another replenishment toner container in accordance with the prior art.

FIG. 34 shows an example of an array of pressure sensors based on MEMS technology. This pressure sensor array H comprises: a substrate formed of glass; a plurality of pressure sensors A arrayed on the substrate with the use of the exposure technology for the manufacturing semiconductor; and a piece of elastic film which covers the sensors.

In this embodiment, thin pressure sensors (thin switch) capable of detecting micro pressure are used as toner sensors. However, the sensors used for toner remainder detection do not need to be limited to those used in this embodiment. In other words, it should be noted here that any of the various known methods may be employed as the method for detecting the amount of the toner remainder in the toner bottle 24, as long as it is capable of accurately detecting the amount of the toner remainder.

Figure 8:
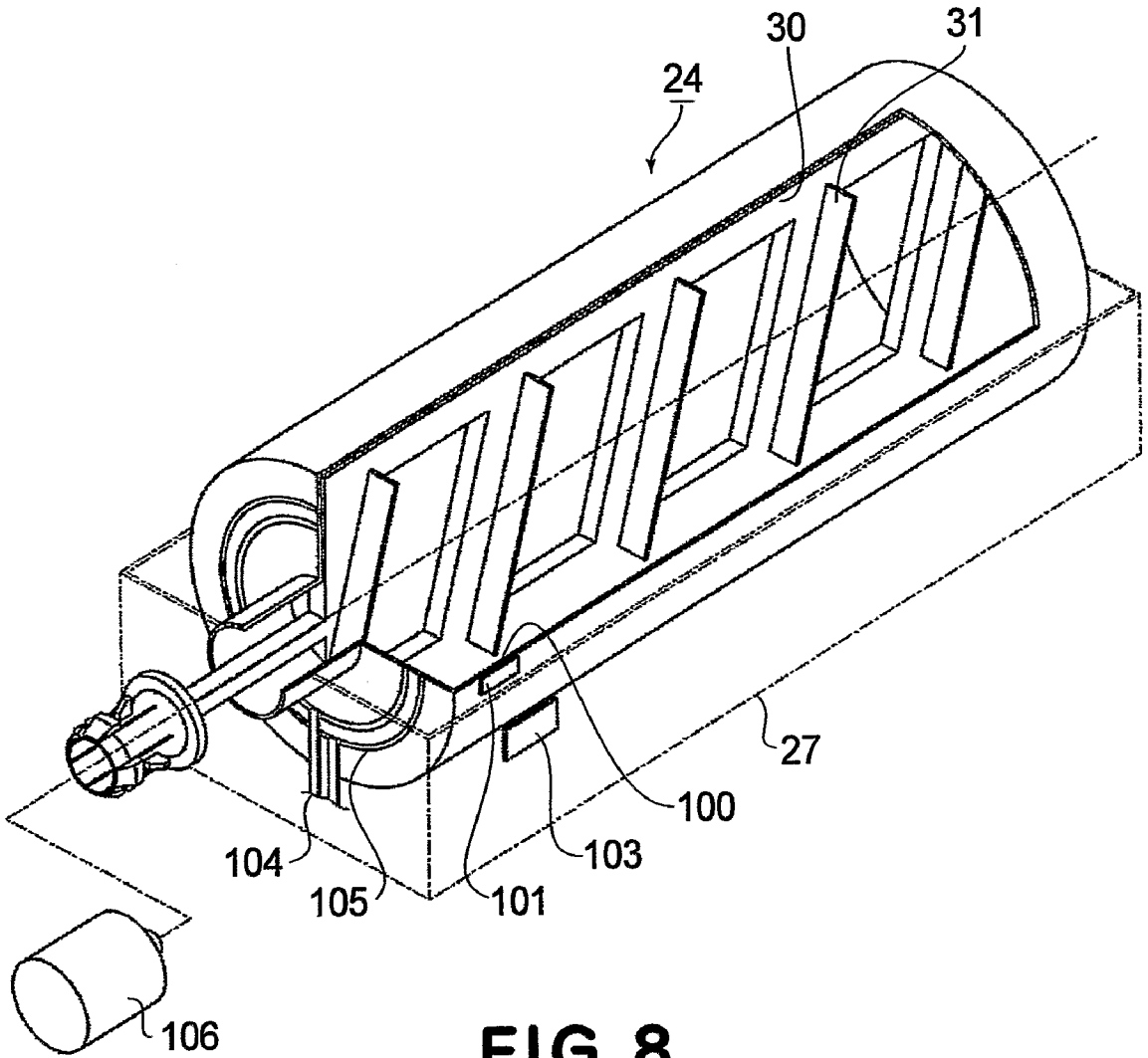
FIG. 8 is a schematic perspective cutaway view of the toner replenishing apparatus of the image forming apparatus, in the first embodiment of the present invention.
Figure 9:
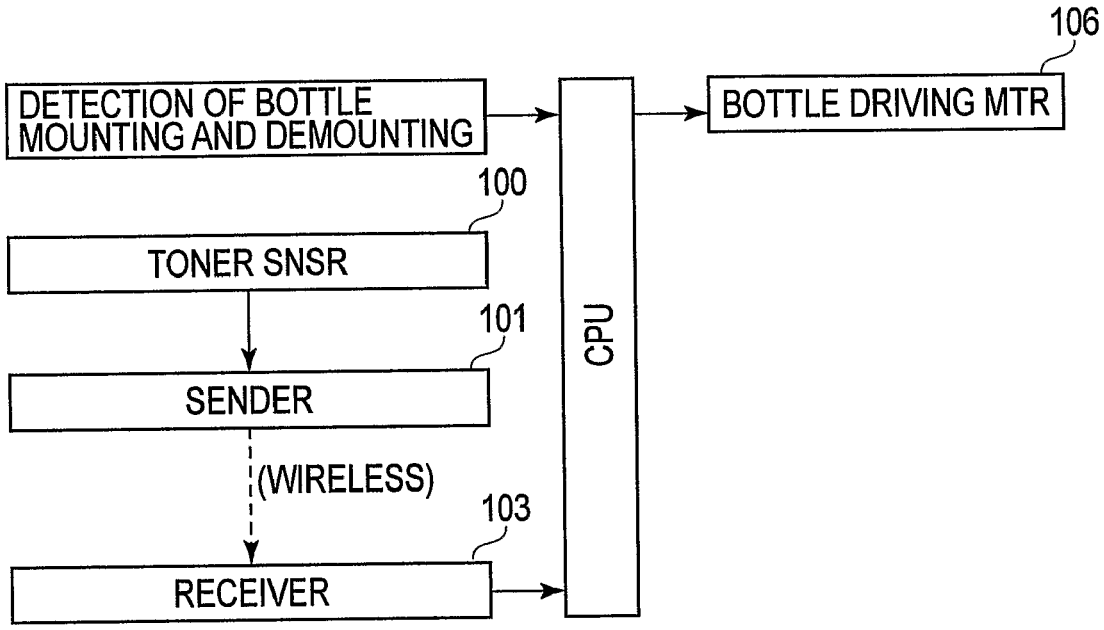
FIG. 9 is a block diagram of the operation for detecting the amount of the toner remainder in the replenishment toner bottle, in the first embodiment.
Figure 10:
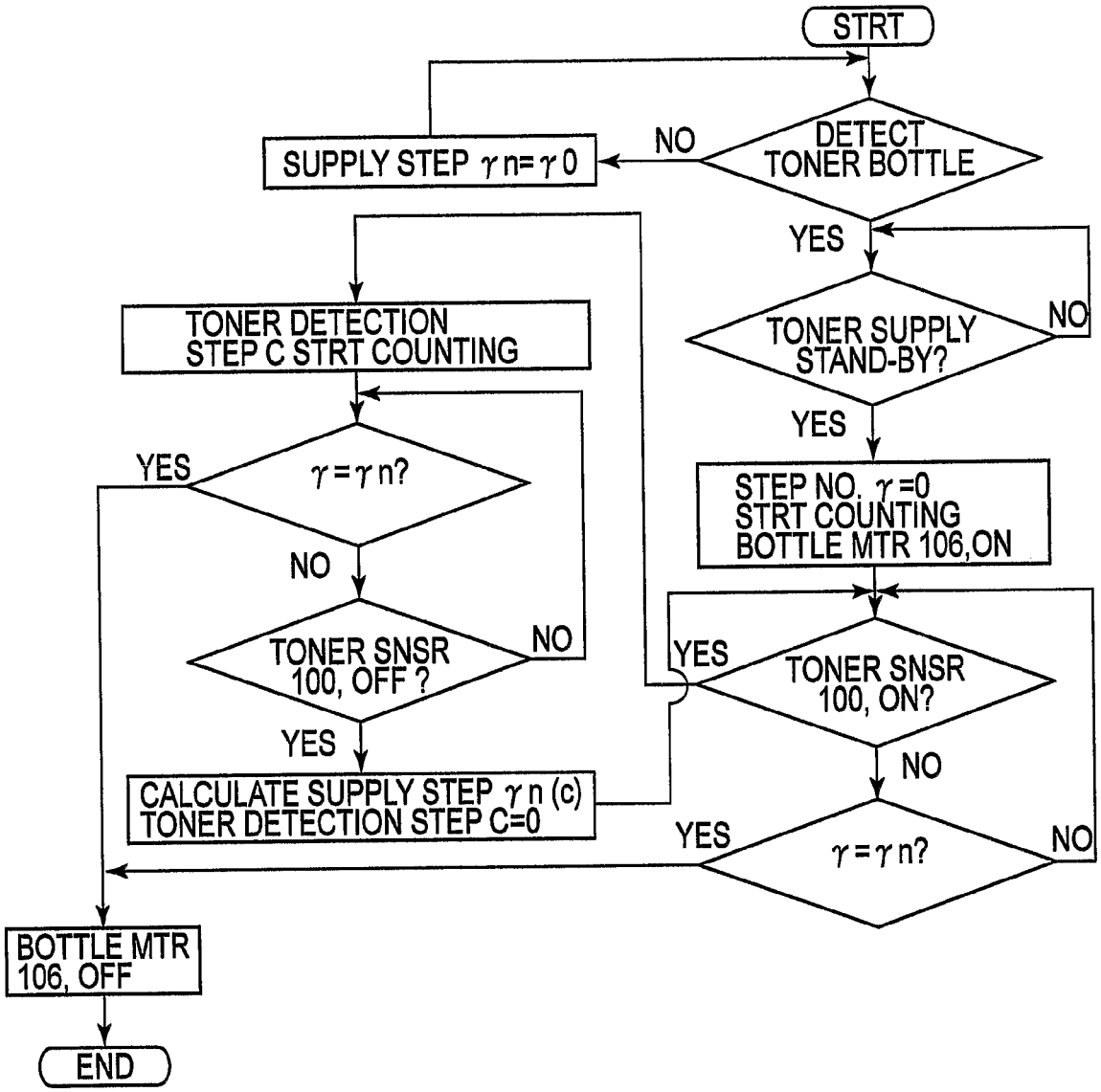
FIG. 10 is a flowchart of the combination of the operation for detecting the toner remainder amount and the operation for replenishing the developing device with the toner, in the first embodiment.

FIG. 8 is a perspective cutaway view of the toner bottle and toner replenishing apparatus, showing the general structures thereof, and FIG. 9 is a block diagram of the toner replenishment operation. FIG. 10 is a flowchart of the toner replenishment operation, showing the general concept thereof.

The toner bottle 24 is provided with: the above-mentioned thin pressure sensor 100 (which hereinafter will be referred to simply as toner sensor) as a detecting means for detecting the amount of the toner remaining in the toner bottle 24; a transmitting portion 101 as a transmitting means for transmitting in the form of wireless signals the information about the amount of the toner remainder detected by the toner sensor 100; a slip ring 105 as an energy receiving portion (electrical contact), which is enabled to slide on a power supply terminal 104, with which the image forming apparatus 1 is provided to supply the toner sensor 100 and transmitting portion 101 with driving energy (electric power). The power supply terminal 104 will be described later in more detail.

As described above, in this embodiment, the image forming apparatus 1 and toner bottle 24 are structured so that even while the toner bottle 24 is rotated, the toner sensor 100 and transmitting portion 101 are allowed to receive driving energy (electric power) from the main assembly of the image forming apparatus 1. More specifically, they are structured so that the amount of the toner remainder can be detected even while the toner bottle 24 is rotated. This is a preferable structural arrangement. Structuring them so that the toner bottle 24 and transmitting portion 101 can receive driving energy from the main assembly of the image forming apparatus 1 prevents the toner bottle 24 from being rendered unnecessarily complicated, and also, prevents the increase in the cost of the toner bottle 24.

The toner sensor 100 and transmitting portion 101 are integrally formed on a common substrate with the use of the above-mentioned MEMS technology.

As for the position of the toner sensor 100, the toner sensor 100 is desired to be attached on the downstream portion of the peripheral surface of the toner proper 28 of the toner bottle 24, in terms of the toner conveyance direction, more specifically, in the adjacencies of the toner outlet 24*a* of the toner bottle 24. Further, it is desired to be attached to the area of the external surface of the bottle proper 28, to which the strip ring 105 is attached.

With the toner sensor 190 positioned closer to the toner outlet 24*a* in terms of the lengthwise direction of the toner bottle 24, even after the rotation of the baffle has caused the toner in the toner bottle 24 to be distributed in the toner bottle 24 in such a manner that the closer to the toner outlet 24, the greater the amount of the toner, the amount of the toner remainder can be satisfactorily detected. In other words, even after the amount of the toner remainder has reduced to a very small value, the amount of the toner remainder can be satisfactorily detected.

In the following description of this embodiment, it is assumed that the toner sensor 100 is disposed on the external surface of the bottle proper 28 of the toner bottle 24, and in the adjacencies of the toner outlet 24*a*.

As for the bottle tray 277, it is provided with the power supply terminal 104, on which the slip ring 105 of the toner bottle 24 slides; and a receiving portion 103 as a receiving means for receiving the information about the amount of the toner remainder transmitted in the form of wireless signals from the transmitting portion 101.

A bottle driving motor 106 as the driving means for rotationally driving the toner bottle 24 is a stepping motor, which is controllable in rotational phase. It is controlled as shown in FIG. 9. That is, the rotation of the toner bottle 24 is controlled by a CPU as a controlling apparatus, according to the signals which indicate whether or not the toner bottle 24 is in the bottle tray 27, and the value computed by the CPU, as the amount by which the bottle driving motor 106 needs to be rotated, based on the information regarding the amount of the toner remainder detected by the toner sensor 100. Incidentally, a structural arrangement may be made so that whether or not the toner bottle 24 is in the image forming apparatus 1 is determined by the toner sensor 100.

In this embodiment, the image forming apparatus 1 is provided with a mechanism for mechanically detecting the presence or absence of the toner bottle 24 in the bottle tray 27. However, the image forming apparatus 1 may be structured so that the presence or absence of the toner bottle 24 is determined with the use of the toner sensor 100. That is, the signals from the toner sensor 100 may be used as the signal for determining whether or not the toner bottle 24 is in the image forming apparatus 1. More concretely, as the receiving portion 103 of the main assembly of the image forming apparatus 1 receives, from the toner sensor 100, a signal which the toner sensor 100 outputs as it detects the presence of toner in the toner bottle 24, the CPU determines that there is a toner bottle in the bottle tray 27.

The bottle driving motor may be a servo motor, or an ultrasonic motor (USM), instead of a stepping motor.

Figure 11:
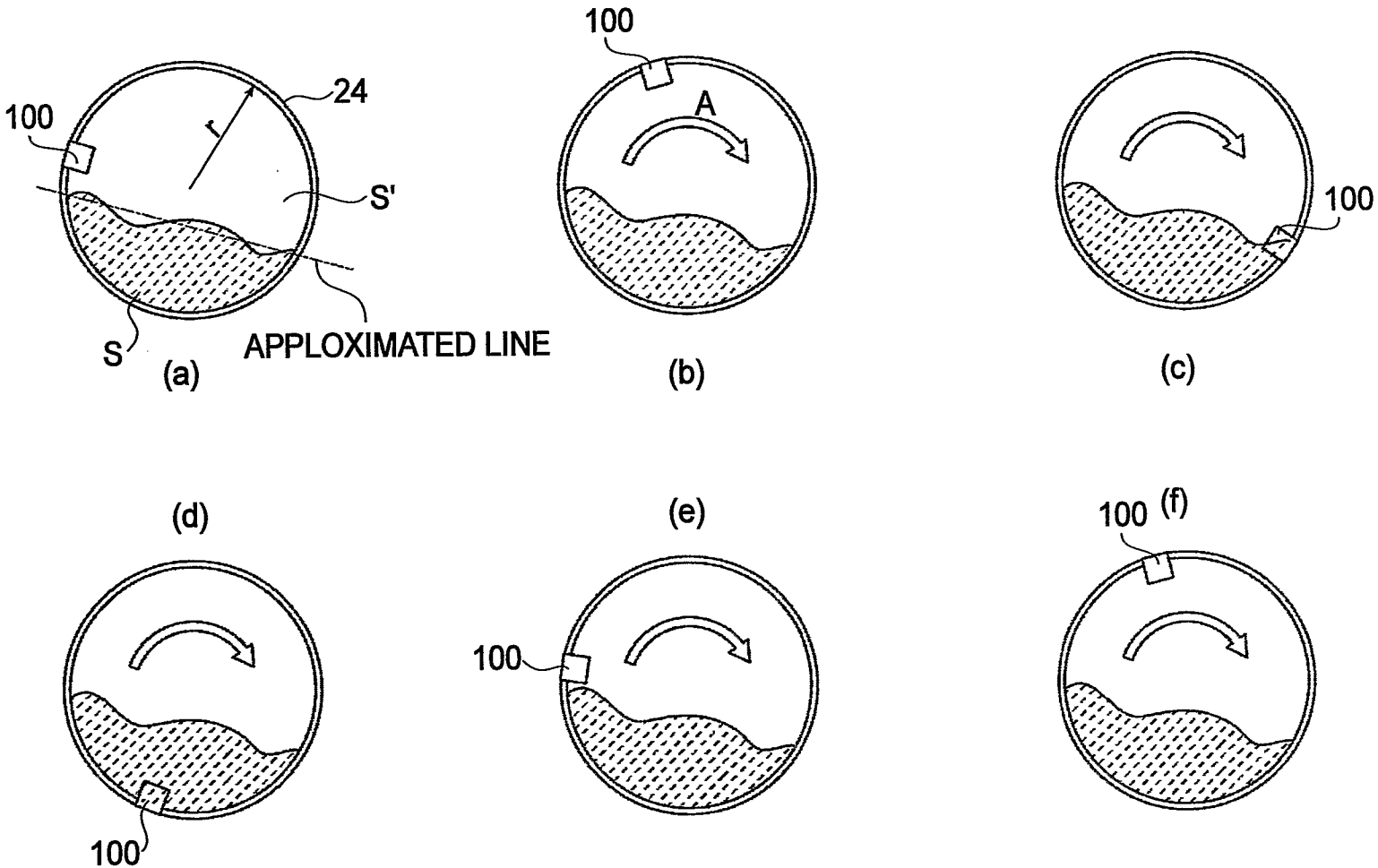
FIG. 11 is a schematic drawing for depicting the toner replenishing operation in the first embodiment.

Next, the flowchart in FIG. 10, which shows the combination of the operation for detecting the amount of the toner remainder, and operation for replenishing the developing device with toner, will be described in conjunction with the concept of how the amount of the toner remainder in the toner bottle 24 is determined, which is shown in FIGS. 11(*a*)-11(*f*). In the following, this embodiment will be described with reference to the so-called block replenishment method, that is, a method of supplying the developing device with toner, by the amount equal to n-times (n=1, 2 . . . (integer)) the predetermined unit amount (minimum amount equivalent to replenishment step count γn, which will be described later), in order to ensure that the developing device is replenished with a precise-amount of toner per toner replenishment operation.

As a toner replenishment request is generated by the image forming portion, the toner replenishment operation is started.

When the toner bottle 24 is already in the bottle tray 27, the value calculated based on the results of the immediately preceding detection of the amount of the toner remainder, is used as the value for motor step count γn per toner replenishment operation.

Whereas, when there is no toner bottle 24 in the bottle tray 27, the motor step count γn per toner replenishment operation is set to the initial value γ0, which is stored in the memory as a storage apparatus, as soon as the toner bottle 24 is set in the bottle tray 27 (Step 1). However, the initial position of the toner sensor 100 in terms of the rotational direction of the toner bottle 24 is random; the toner bottle 24 does not need to be placed in the bottle tray 27 so that the toner sensor 100 is positioned at a predetermined angle from the referential point in terms of the rotational direction of the toner bottle 24.

As the toner bottle 24 is readied to allow the toner to be discharged from the toner bottle 24 (toner bottle is set in image forming apparatus, is connected to image forming apparatus, and is unsealed (toner outlet is unsealed)) (Step 2), a counter for counting the number of times γ the bottle driving motor 106 is rotated in proportion to the amount by which the developing device is to be replenished with toner, is set to zero. Then, at the same time as the counting of the drive steps begins, the toner bottle driving motor 106 is activated, rotating the toner bottle 24 in the direction indicated by an arrow mark A to replenish the developing device with toner, as shown in FIGS. 11(*a*) and 11(*b*) (Step 3).

Next, referring to FIG. 11(*c*), as soon as the presence of the toner is detected by the toner sensor 100 (Step 4), it is started to measure the length of time, in terms of the step count c, the presence of the toner is detected by the toner sensor 100 (Step 6).

The toner bottle 24 is continuously rotated in the arrow mark A direction as shown in FIG. 11(*d*). Then, as the absence of the toner is detected by the toner sensor 100 at the point shown in FIG. 11(*e*) (Step 8), it is stopped to measure the length of time, in terms of the step counts c, the bottle driving motor is rotated. Then, the replenishment step count γn is altered to a new value computed by the CPU, based on the cumulative step count c accumulated by the CPU, which is equivalent to the amount of the toner remainder in the toner bottle 24, (Step 9).

In other words, in this embodiment, the replenishment step count γn is adjusted by the CPU according to the amount of the toner remainder in the toner bottle 24, in order to prevent from varying, the amount by which the toner is discharged from the toner bottle 24 while the toner bottle 24 is rotated by a predetermined angle according to the amount of the toner remainder in the toner bottle 24.

As described above, the amount of the toner remainder in the toner bottle 24 can be determined by the CPU based on the cumulative value of the step count c, which is equivalent to the length of time the presence of the toner is detected while the toner bottle 24 is rotated one full turn during the toner replenishment operation.

Thereafter, the toner bottle 24 is rotated until the drive step count γ reaches the replenishment step count γn, while the process of replenishing the developing device with toner, the process of detecting the amount of the toner remainder in the toner bottle 24, and the process of computing the replenishment step count γn, are repeatedly carried out. (Step 7).

Then, as the drive step count γ reaches n-times the replenishment step count γn, which corresponds to the amount by which the developing device is to be replenished with toner, the driving of the bottle driving motor 106 is stopped (Step 10).

Figure 12:
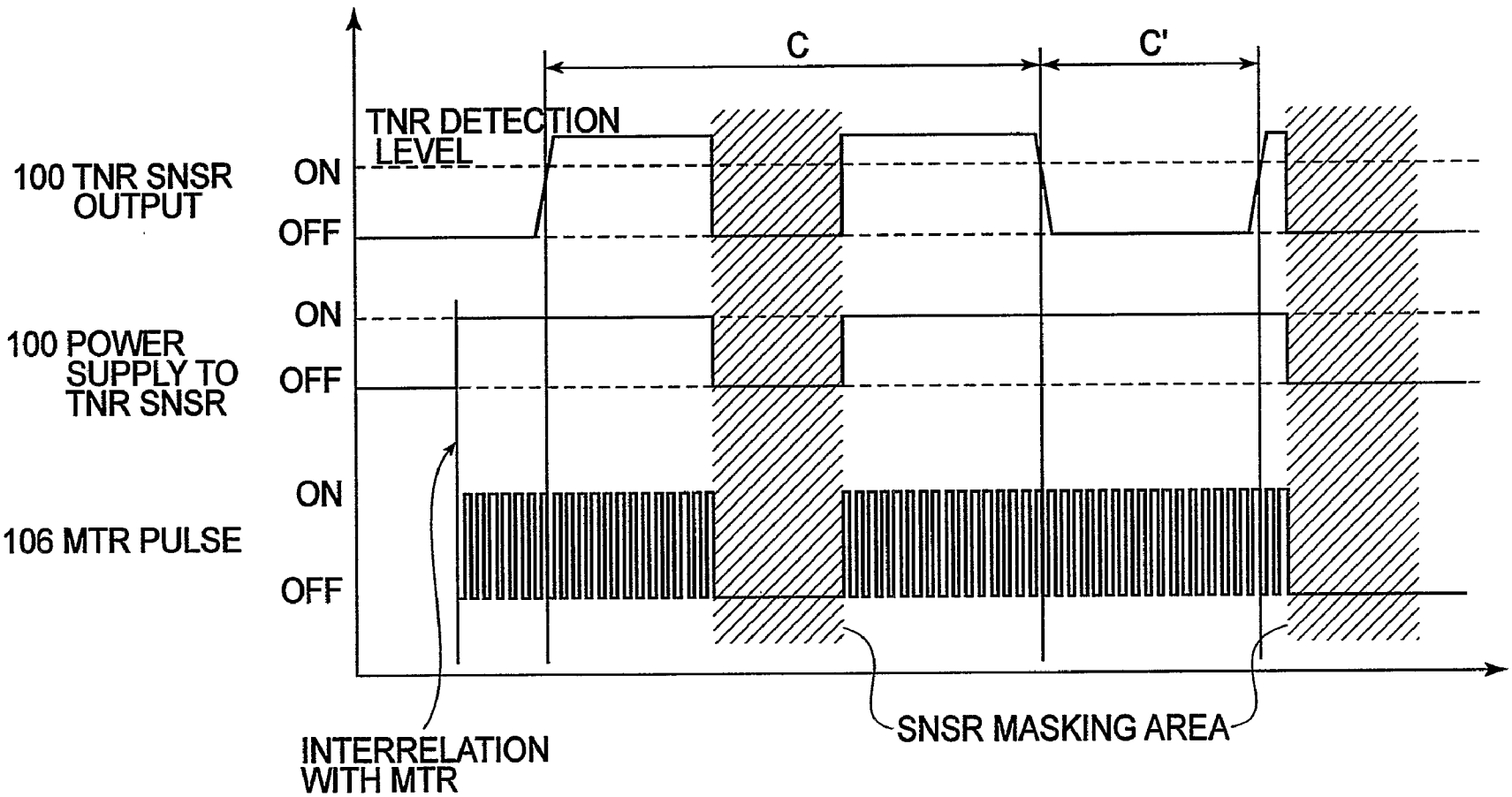
FIG. 12 is a diagram for showing the faculties of the various sensors involved in the toner replenishing operation, in the first embodiment.

FIG. 12 is a diagram which roughly shows the signal outputted for supplying the toner sensor 100 with power, the signal outputted by the toner sensor 100 as the presence of the toner is detected by the toner sensor 100, and the control signal (in the form of pulse) outputted for driving the bottle driving motor in steps, during the operation depicted by FIGS. 11(*a*)-11(*e*). It shows the detection of the presence and absence (ON and OFF of sensor) of the toner by the toner sensor 100, which occurs while the toner bottle 24 is in the conditions shown in FIGS. 11(*a*)-11(*e*).

Even if the motor stops while the toner sensor 100 is in the range in which the presence of toner is detected by the toner sensor 100 as shown in FIG. 11(*d*), the amount of the toner remainder can be accurately detected, because the rotational phase of the toner bottle 24 is detected based on the step count of the bottle driving motor.

In order to extend the service life of the toner sensor 100, and reduce power consumption, the power delivery to the toner sensor 100 is tied to the activation of the bottle driving motor.

Next, the actual method for detecting the amount of the toner remainder (volume V), and the actual method for computing the toner replenishment step count γn per toner replenishment operation, will be described.

When $C_0$ stands for the step count per full rotation of the toner bottle 24 by the toner bottle driving motor 106; c: the step count of the bottle driving motor while the toner sensor 100 is outputting the signals that indicate the presence of the toner per full rotation of the toner bottle 24; r: internal diameter of toner bottle 24, the cross-sectional area S, shown in FIG. 11, of the body of the toner remainder in the toner bottle 24 is expressed by the following approximation.

$$S = r^2\left(\frac{\pi c}{C_0} - \cos\left(\frac{\pi c}{C_0}\right)\sin\left(\frac{\pi c}{C_0}\right)\right)$$

Incidentally, the amount of the toner remainder can be determined from the step count c of the toner bottle driving motor during the period in which toner sensor 100 is outputting the signals that indicate the absence of the toner per full rotation of the toner bottle 24. In this case, the cross-sectional area S' of the body of the toner remainder in the toner bottle 24 can be expressed by the following approximation.

$$S' = \pi r^2 - r^2\left(\frac{\pi c'}{C_0} - \cos\left(\frac{\pi c'}{C_0}\right)\sin\left(\frac{\pi c'}{C_0}\right)\right)$$

The following description will be given with reference to S. When the length of the toner bottle 24 is L, and the correction factor is α, the volume V of the toner remainder in the toner bottle 24 can be expressed by the following approximation.

$$V = \alpha \cdot S \cdot L.$$

This correction factor α is such a factor that is related to the shape of the cross section of the body of the toner remainder, perpendicular to the lengthwise direction of the toner bottle 24. It is to be determined by experiments, according to the position of the toner sensor 100 in terms of the lengthwise direction of the toner bottle 24, level of the toner detection signal from the toner sensor 100, angles and shapes of the baffle 30 and tilted plates 31 in the toner bottle 24, etc.

Further, during the initial stage of the toner replenishment operation with the use of a brand-new toner bottle 24, this correction factor .alpha. is a variable that is dependent on the length of time the toner is stirred. However, as the body of toner in the toner bottle 24 is sufficiently stirred, the correction factor α becomes constant (variable) proportional to the cross-sectional area S.

$$V = \alpha(S) \cdot S \cdot L.$$

As described above, the amount of the toner remainder can be precisely detected with the employment of the above-described structural arrangement and controlling method.

The image forming apparatus 1 is structured so that the information regarding the amount of the toner remainder in the toner bottle 24 is successively displayed by the CPU on the control panel, as an information disseminating means, to inform in succession an operator of the information regarding the amount of the toner remainder, as it is obtained.

When the image forming apparatus 1 is connected to a host computer to be used as a network printer, such a structural arrangement is made that the CPU transmits the information regarding the amount of the toner remainder to the host computer through the network, making it possible for an operator to be continuously informed of the amount of the toner remainder through a monitor connected to the host computer.

The amount ΔVn by which the toner is discharged from the toner bottle 24 per rotational movement of the toner bottle 24 between the (n−1)-th and n-th detections of the amount of the toner remainder is given by the following approximation.

$$\begin{aligned}\Delta V_n &= \alpha(S)\cdot(S_{n-1} - S_n)L \\ &= \alpha(S)\cdot r^2\left\{\left(\frac{\pi c_{n-1}}{C_0} - \cos\left(\frac{\pi c_{n-1}}{C_0}\right)\sin\left(\frac{\pi c_{n-1}}{C_0}\right)\right) - \left(\frac{\pi c_n}{C_0} - \cos\left(\frac{\pi c_n}{C_0}\right)\sin\left(\frac{\pi c_n}{C_0}\right)\right)\right\}L\end{aligned}$$

Thus, the motor step count γn per toner replenishment operation is controlled so that ΔVn/γn remains constant.

$$\frac{\Delta V_n}{\gamma_n} = Const.$$

With the employment of this control, it is possible to stabilize the amount by which the developing device is replenished with the toner from the toner bottle 24, regardless of the amount of the toner remainder in the toner bottle 24.

Further, by using the average value of the amounts by which the toner is discharged from the toner bottle 24 m times between the (n-m)-th detection of the toner remainder amount and m-th detection, it is possible to reduce the errors resulting from the detection errors, further stabilizing the amount by which the developing device is replenished with the toner from the toner bottle 24.

$$\Delta \overline{V}_n = \frac{\alpha(S)\cdot(S_{n-m} - S_n)L}{m}$$

$$\frac{\Delta \overline{V}_n}{\gamma_n} = Const.$$

In this embodiment, electrical power is supplied to the toner sensor 100 and transmitting portion. 101 through the slip ring 105 and power supply brush 104. However, the structural arrangement for supplying the toner sensor 100 and transmitting portion 101 may be as shown in FIGS. 13-15.

Figure 13:
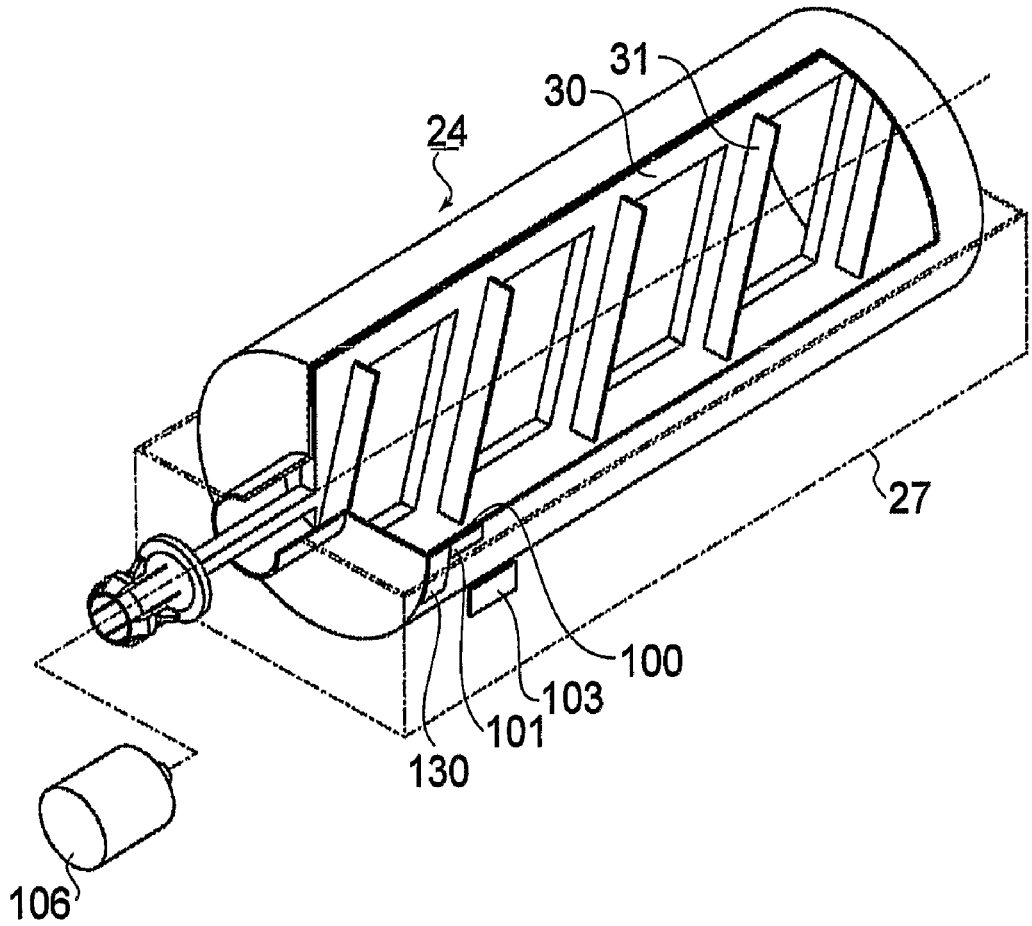
FIG. 13 is a schematic perspective cutaway view of a toner replenishing apparatus similar in structure to the toner replenishing apparatus in the first embodiment, showing the general structure thereof.

The toner bottle 24 in FIG. 13 is provided with a power storage portion 130 with a sufficient capacity, from which power is supplied to the toner sensor 100 and transmitting portion 101.

Figure 14:
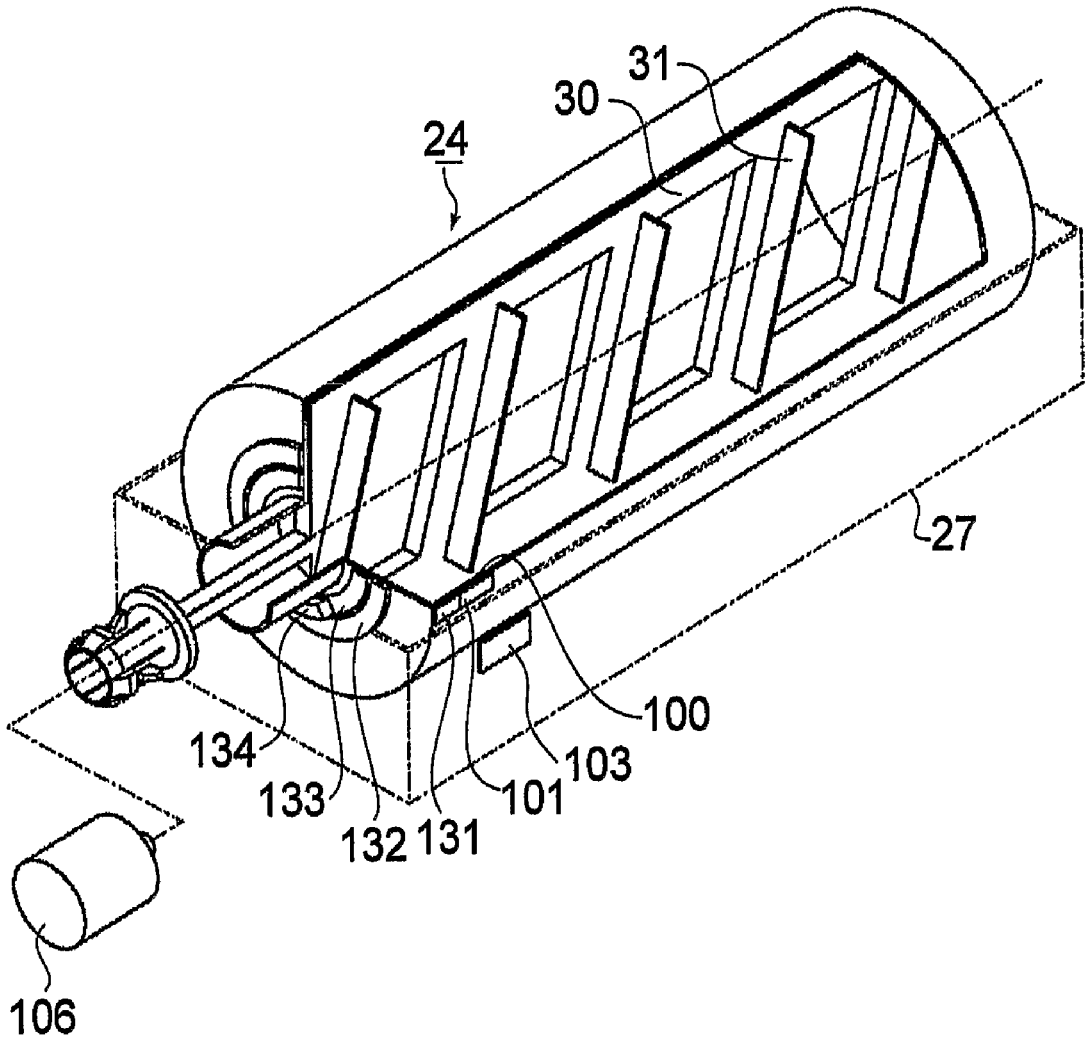
FIG. 14 is a schematic perspective cutaway view of another toner replenishing apparatus similar in structure to the toner replenishing apparatus in the first embodiment, showing the general structure thereof.

The toner bottle 24 in FIG. 14 is provided with a coil 132 for power generation, and a magnet 133 for power generation. To the magnet 133, a weight 134 is attached. The magnet 133 is rotatably attached to the toner bottle 24 so that as the toner bottle 24 is rotated, the magnet 133 is kept stationary by the weight 134 while the coil 132 rotates with the toner bottle 24. Thus, as the toner bottle 24 is rotated, electric power is generated. The generated power is temporarily stored in the power storage portion 131, and then, it is supplied to the toner sensor 100 and transmitting portion 101 with a predetermined timing.

Figure 15:
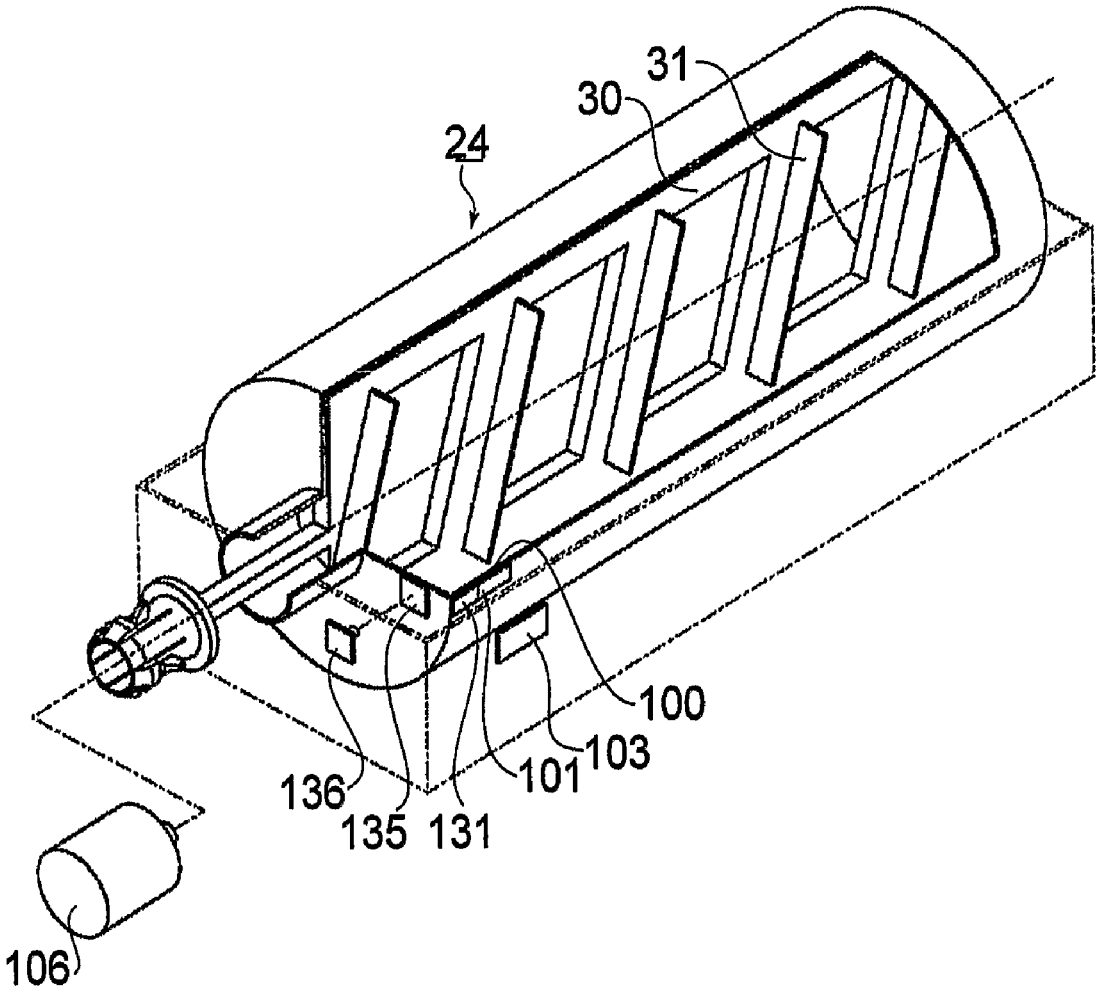
FIG. 15 is a schematic perspective cutaway view of another toner replenishing apparatus similar in structure to the toner replenishing apparatus in the first embodiment, showing the general structure thereof.

The toner bottle 24 in FIG. 15 is provided with a power generating portion 135 which generates electrical power as it receives light, and a power storage portion 131, whereas the bottle tray 27 is provided with a light emitting portion 136. The electric power generated by the power generating portion 135 as the power generating portion 135 receives the light from the light emitting portion 136 is temporarily stored in the power storage portion 131, and is supplied to the toner sensor 100 and transmitting portion 101 with a predetermined timing.

It is possible to supply the toner sensor 100 and transmitting portion 101 with the thermoelectrically generated power instead of the photoelectrically generated power.

From the standpoint of size reduction, it is desired that the power storage portion 130, toner sensor 100, and transmitting portion 101 shown in FIG. 13, are integrally formed on a common substrate with the use of the MEMS technology. Similarly, it is desired that the power generating portions 132, 133, and 134 and power storage portion 131 in FIG. 14 are formed on a common substrate, and also, that the power generating portion 135, power storage portion 131, toner sensor 100, and transmitting portion 101 in FIG. 15 are formed on a common substrate.

Also in this embodiment, the process of detecting the amount of the toner remainder in the toner bottle 24 is carried out at the same time as the process of replenishing the developing device with the toner from the toner bottle 24. However, the former does not need to be carried out at the same time as the latter. For example, the process of detecting the amount of the toner remainder in the toner bottle 24 may be independently carried out from the process of replenishing the developing device with the toner from the toner bottle 24, while the toner outlet 24*a* of the toner bottle 24 is still sealed with the cap 29 although the toner bottle has been mounted in the image forming apparatus 1 and connected to the main assembly of the image forming apparatus 1, being ready to be driven. This structural arrangement is convenient it that even when the toner replenishment is unnecessary, the amount of the toner remainder can be detected by causing the image forming apparatus 1 to carry out the process of automatically sealing the toner outlet 24*a* with the cap 29. Further, this structural arrangement is such that as soon as the process of detecting the amount of the toner remainder is completed, the process of unsealing the toner outlet 24*a* is automatically carried out by the image forming apparatus 1, readying the toner bottle 24 for toner discharge. Therefore, the toner replenishment request resulting from toner consumption can be met whenever it is generated.

Figure 16:
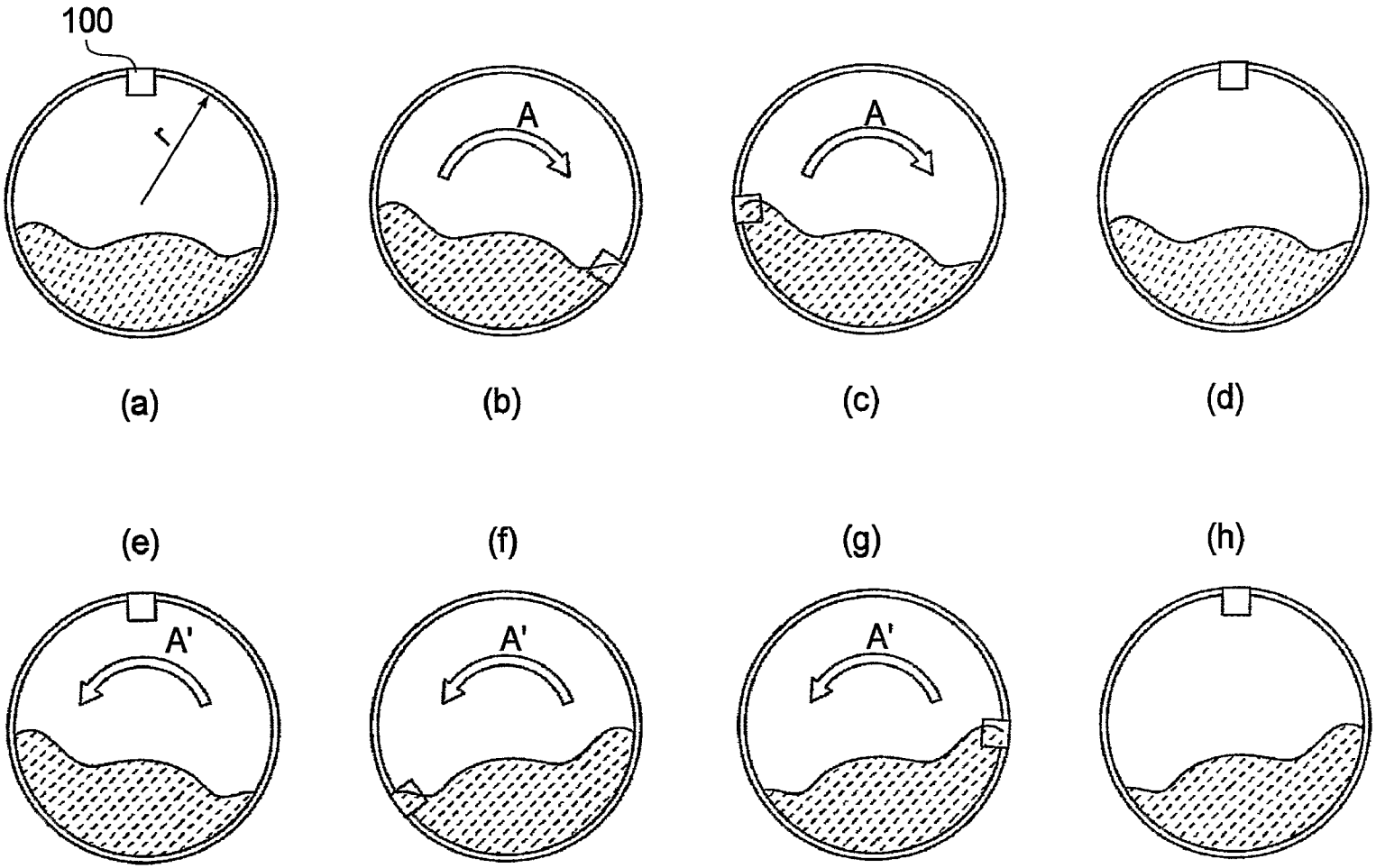
FIG. 16 is a schematic drawing for depicting the toner replenishing operation of one of the toner replenishing apparatus similar in structure to the toner replenishing apparatus in the first embodiment.

Although this embodiment was described with reference to the structural arrangement in which the toner in the toner bottle 24 is supplied to the developing device by rotating in the direction indicated by the arrow mark A as shown in FIGS. 11(*a*)-11(*b*), the same effects as those achieved by this embodiment can also be achieved by such a structural arrangement that the toner in the toner bottle 24 is conveyed toward the toner outlet 24*a* by alternately rotating the toner bottle 24 in the arrow mark A direction and arrow mark A' direction (direction opposite to arrow mark A direction) as shown in FIGS. 16(*a*)-16(*b*).

In the case of the above-described structural arrangement which utilizes the oscillatory rotation of the toner bottle 24, the amount of the toner remainder in the toner bottle 24 is determined based on the cumulative value of the step count c in the period in which the signals indicating the presence of toner are outputted during the period between when the internal state of the toner bottle 24 is as shown in FIG. 16(*a*) and when the internal state of the toner bottle 24 is as shown in FIG. 16(*h*). This method also can successively determine the amount of the toner remainder in the toner bottle 24 just as precisely as the above-described method.

With the employment of the above-described structural arrangement, it is possible to prevent an image forming apparatus from becoming complicated in structure, and increasing in cost.

Also with the employment of the above-described structural arrangement, the amount of the toner remainder in the toner bottle 24 can be precisely and successively determined. Therefore, it becomes possible to inform a user of the need for replenish toner bottle replacement, at an opportune time. In addition, it enables a user to schedule the times for ordering or replacing the toner bottle 24, according to the user's own convenience. Therefore, it is possible to minimize the space necessary for storing the replacement toner bottles, and substantially reduce the downtime (period of time when image forming operation cannot be performed) of an image forming apparatus attributable to the problem that the toner bottle 24 runs out of the toner. In other words, the employment of the above-described structural arrangement can drastically improve an image forming apparatus in usability.

Also with the employment of the above-described structural arrangement, it becomes possible to stabilize the amount by which the toner is discharged from the toner bottle 24 to replenish the developing device with the toner. Therefore, it is possible to simplify in function, or eliminate, the hopper portion which is for temporarily storing the toner discharged from the toner bottle 24 to ensure that the developing device is continuously replenished with a stable amount of toner.

Further, the function of the hopper portion, as a temporary toner storage portion, disposed between the toner bottle 24 and developing device to ensure that a substantial number of copies can be made even after it is detected that the toner bottle 24 has completely run out of toner, becomes unnecessary. In other words, the hopper portion itself becomes unnecessary. Thus, the above-described structural arrangement makes it possible to further simplify, and reduce in size, the main assembly of an image forming apparatus.

Embodiment 2

In FIGS. 17-20, the general structure of the portion for detecting the amount of the toner remainder in the toner bottle 24, which characterizes this embodiment, is shown.

In this embodiment, the toner bottle 24 is provided with a plurality of small toner sensors, which are disposed in a plurality of straight lines on the external surface of the toner bottle 24. The toner sensors in this embodiment are those realized with the use of the MEMS technology or the like. The methods preferably usable, in this embodiment, for detecting the amount of the toner remainder in the toner bottle 24 are the same as those in the first embodiment, for example, thin switches or pressure sensors of the magnetic permeability detection type, magnetic type, piezoelectric vibration type, light transmission type, and the like, which are capable of detecting a minute amount of pressure.

In this embodiment, magnetic toner is used as developer. Therefore, magnetic sensors are employed as toner sensors to use the toner remainder amount detecting method of the magnetic permeability detection type.

Figure 17:
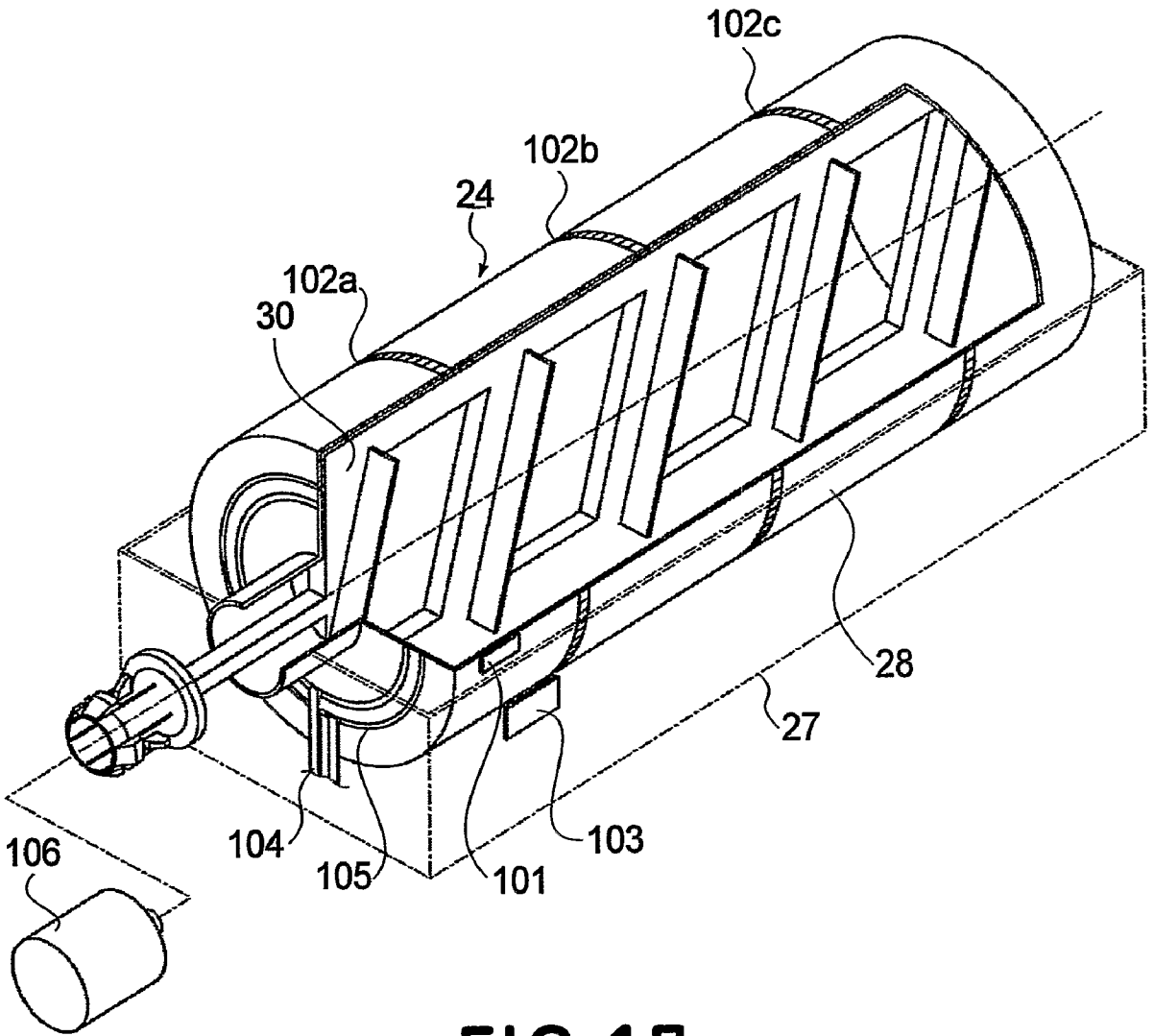
FIG. 17 is a schematic perspective cutaway view of the toner replenishing apparatus of the image forming apparatus, in the second embodiment of the present invention.
Figure 18:
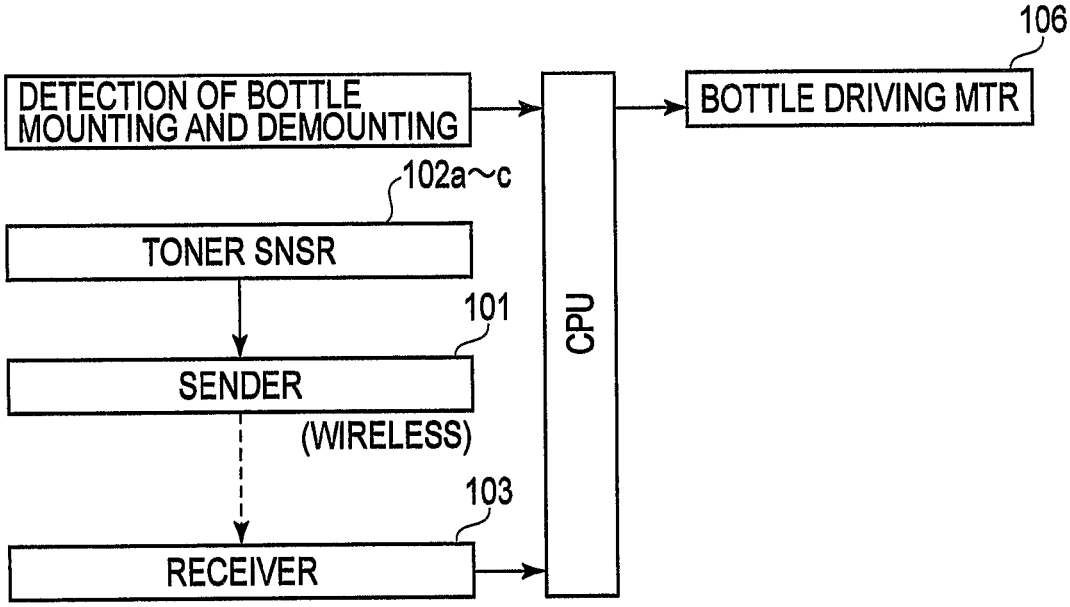
FIG. 18 is a block diagram of the operation for detecting the amount of the toner remainder in the replenishment toner bottle, in the second embodiment.
Figure 19:
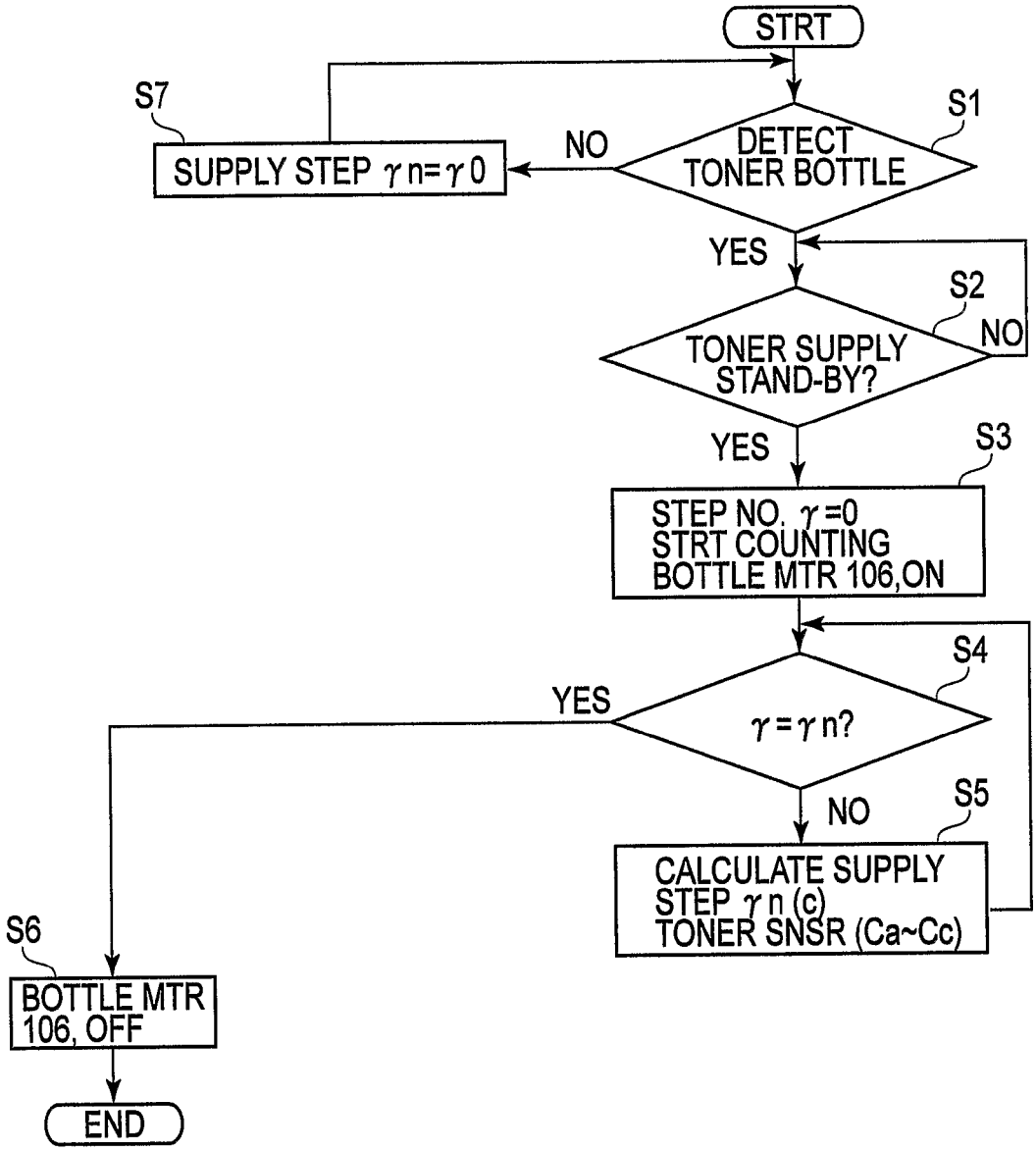
FIG. 19 is a flowchart of the combination of the operation for detecting the toner remainder amount and the operation for replenishing the developing device with the toner, in the second embodiment.

FIG. 17 is a schematic perspective view of the toner bottle 24 in this embodiment, and FIG. 18 is a block diagram of the operation for detecting the toner remainder amount. FIG. 19 is a flowchart of the combination of the operation for detecting the amount of the toner remainder in the toner bottle 24, and the operation for replenishing the developing device with the toner from the toner bottle 24.

The toner bottle 24 in this embodiment is provided with three sets 102*a*-102*c* of toner sensors, each set of which comprises a plurality of toner sensors aligned in a straight line on the external surface of the bottle proper 28 of the toner bottle 24, in a manner of circling the bottle proper 28 in the circumferential direction. The three sets 102*a*-102*c* of toner sensors are disposed with roughly equal intervals.

Electric power is supplied, with a predetermined timing, to the toner sensor sets 102*a*-102*c* through a power terminal 104 attached to the bottle tray 27, and a slip ring 105 attached to the toner bottle 24.

Each of the plurality of toner sensors of the sensor sets 102*a*-102*c* is capable of detecting the presence or absence of the toner in the toner bottle 24. The information regarding the presence or absence of the toner detected by each toner sensor is transmitted in the form of a wireless signal from a transmitting portion 101 attached to the toner bottle 24 to a receiving portion 103 attached to the bottle tray 27.

Figure 20:
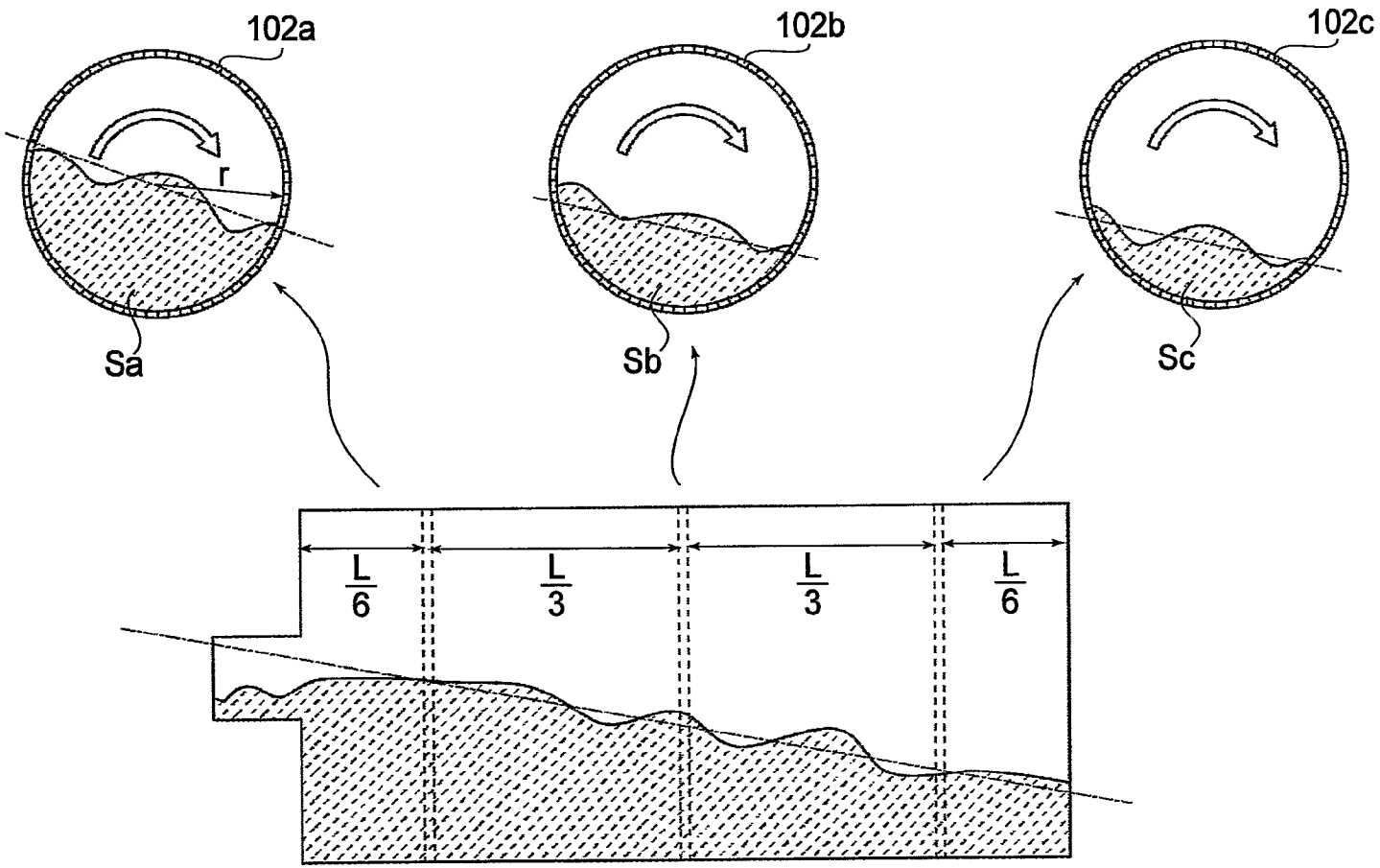
FIG. 20 is a schematic drawing for depicting the concept of how the amount of the toner remaining in the replenishment toner bottle is detected by each of the plurality of toner sensors, in the second embodiment.

FIG. 20 is a schematic sectional view of the toner bottle 24, showing the general concept of how the amount of the toner remainder in the toner bottle 24 is detected. Next, the flowchart, in FIG. 19, of the operation for detecting the toner remainder amount in the toner bottle 24 and the operation for replenishing the developing device with the toner, will be described in conjunction with the general concept of how the toner remainder amount is detected, shown in FIG. 20.

As a toner replenishment request is generated by the image forming portion, the toner replenishment operation is started. When the toner bottle 24 is already in the toner bottle tray 27, the value obtained by the previous computation is used as the motor step count γn by which the bottle driving motor is to be rotated per toner replenish operation. Whereas, when no toner bottle is in the bottle tray 27, the step count γ is set to the initial value γ0 (Step 1) as soon as a toner bottle 24 is set in the bottle tray 27. Then, as the toner bottle 24 is readied for toner replenishment (Step 2), the counter for counting the number of steps by which the toner bottle driving motor 106 is rotated is set to zero. Then, the toner bottle driving motor 106 is activated to rotate the toner bottle 24 in the direction indicated by an arrow mark in FIG. 20, and at the same time, the number of times (step count γ) the toner bottle driving motor 106 is activated begins to be counted by the counter (Step 3).

As the toner is detected by the sets 102*a*-102*c* of toner sensors as shown in FIG. 20, the replenishment count γn is computed by the CPU based on the number of the toner sensors (ca-cc) of the toner sensor sets 102*a*-102*c*, which detected the toner. Then, the old replenishment step count γn is replaced with the newly computed value (Step 5). The toner bottle 24 is continuously rotated in the arrow mark direction in FIG. 20 until the step count γ of the bottle driving motor 106 reaches the newly computed replenishment step count γn, while the process of replenishing the developing device with toner, the process of detecting the amount of the toner remainder in the toner bottle 24, and the process of computing the proper replenishment step count γn, are repeated (Step 4). The driving of the bottle driving motor 106 is stopped as soon as the value in the counter for counting the number of steps the bottle driving member 106 has been driven reaches the replenishment step count γn (motor activation count γ=replenishment step count γn) (Step 6).

The positioning of the toner sensors 102 is desired to be similar to that in the first embodiment. That is, the toner sensors 102 are desired to be disposed on the surface of the toner bottle 24, on which the slip ring 105 is present near the toner outlet 24*a*, or the external surface of the bottle proper 28 of the toner bottle 24, as in the first embodiment, from the standpoint of the control of the process of detecting the toner remainder amount. In this embodiment, the toner sensors are disposed on the peripheral surface of the bottle proper 28 of the toner bottle 24, for the simplification of the calculation. More specifically, the three sets 102*a*-102*c* of toner sensors are disposed on the peripheral surface of the bottle proper 28 so that the interval between the toner sensor sets 102*a* and 102*b*, and the interval between the toner sensor sets 102*b* and 102*c* become L/3 (L being length of bottle proper), and also, so that the distance between the toner sensor set 102*a* and the end of the bottle proper on the same side of the toner bottle 24 in terms of the lengthwise direction of the toner bottle 24, and the distance between the toner sensor set 102*c* and the other end of the bottle proper, become L/6.

The cross-sectional area S of the body of the toner remainder in the toner bottle 24 shown in FIG. 20 can be expressed in the following approximation, wherein $C_0$ stands for the total number of toner detecting portions (toner sensors); $C_a$-$C_c$ stand for the numbers of toner sensors of each toner sensor sets 102*a*-102*c* which are detecting the presence of the toner; and r stands for the internal diameter of the bottle proper 28 of the toner bottle 24.

$$S_i = r^2\left(\frac{\pi c_i}{C_0} - \cos\left(\frac{\pi c_i}{C_0}\right)\sin\left(\frac{\pi c_i}{C_0}\right)\right)$$

Further, the volume V of the toner remainder in the toner bottle 24 can be expressed by the following approximation, by detecting the presence or absence of the toner in the toner bottle 24 with the use of the above-described structural arrangement.

$$V = \frac{1}{3}\sum_i S_i L$$

Further, the amount ΔVn by which the toner is to be discharged from the toner bottle 24 per rotational movement thereof to replenish the developing device with the toner, between the (n−1)-th detection of the toner remainder amount and n-th detection, and the average value of the amount ΔVn by which the toner is discharged from the toner bottle 24 m times between the (n-m)-th detection of the toner remainder amount, and the m-th detection, can be obtained from the following approximations.

$$\Delta Vn = V_{n-1} - Vn$$

$$\Delta \overline{V}_n = \frac{V_{n-m} - V_n}{m}$$

Thus, motor step count γn per toner replenishment operation is controlled so that ΔVn/γn always remains constant.

$$\frac{\Delta V_n}{\gamma_n} = Const.$$

$$\frac{\Delta \overline{V}_n}{\gamma_n} = Const.$$

With the employment of the above-described structural arrangement and control, it is possible to stabilize the amount by which the toner is discharged for the replenishment of the developing device with the toner, regardless of the amount of the toner remainder in the toner bottle 24.

As described above, this embodiment in which a substantial number of minute toner detection elements realized with the use of the MEMS technology are disposed on the peripheral surface of the toner bottle 24 in a plurality of straight lines, in a manner to circle the peripheral surface of the toner bottle 24, makes it possible to instantly detect the amount of the toner remainder in the toner bottle 24, regardless of whether the toner bottle 24 is rotating or stationary, making it therefore possible to stabilize the amount by which the toner is discharge from the toner bottle 24 to replenish the developing apparatus with the toner.

In this embodiment, the toner bottle 24 is provided with three sets of toner sensors, each set of which comprises a plurality of toner sensors aligned in straight line. The number of the toner sensor sets, and number of toner sensors in each toner sensor set, do not need to be limited to the abovementioned ones.

Also in this embodiment, the entirety of the toner bottle 24, inclusive of the bottle proper 28 connected to the baffle 30, is rotated. Obviously, however, the same effects as those produced by the preceding embodiment can also be produced by a structural arrangement in which the bottle proper 28 is anchored to the main assembly of the image forming apparatus 1 in a virtually unrotatable manner, and the baffle 30 alone rotates by receiving rotational driving force from the main assembly of the image forming apparatus 1.

Embodiment 3

In FIGS. 21-25, the general structure of the portion for detecting the amount of the toner remainder in the toner bottle 24, which characterizes this embodiment, is shown.

As for the widely known methods for detecting the amount of the toner remainder in the toner bottle 24, there are the toner remainder detection methods of the magnetic permeability detection type, magnet type, piezoelectric vibration type, light transmission type, etc. When magnetic toner is used, any of the above listed methods is usable. However, when nonmagnetic toner is used, the toner remainder detecting method of the piezoelectric vibration type or light transmission type is used, because when nonmagnetic toner is used, magnetism is not available for detecting the presence of the toner.

In this embodiment, toner sensors of the light transmission type are used. However, this does not mean that the compatibility of the present invention is limited to the toner sensors of the light transmission type.

Figure 21:
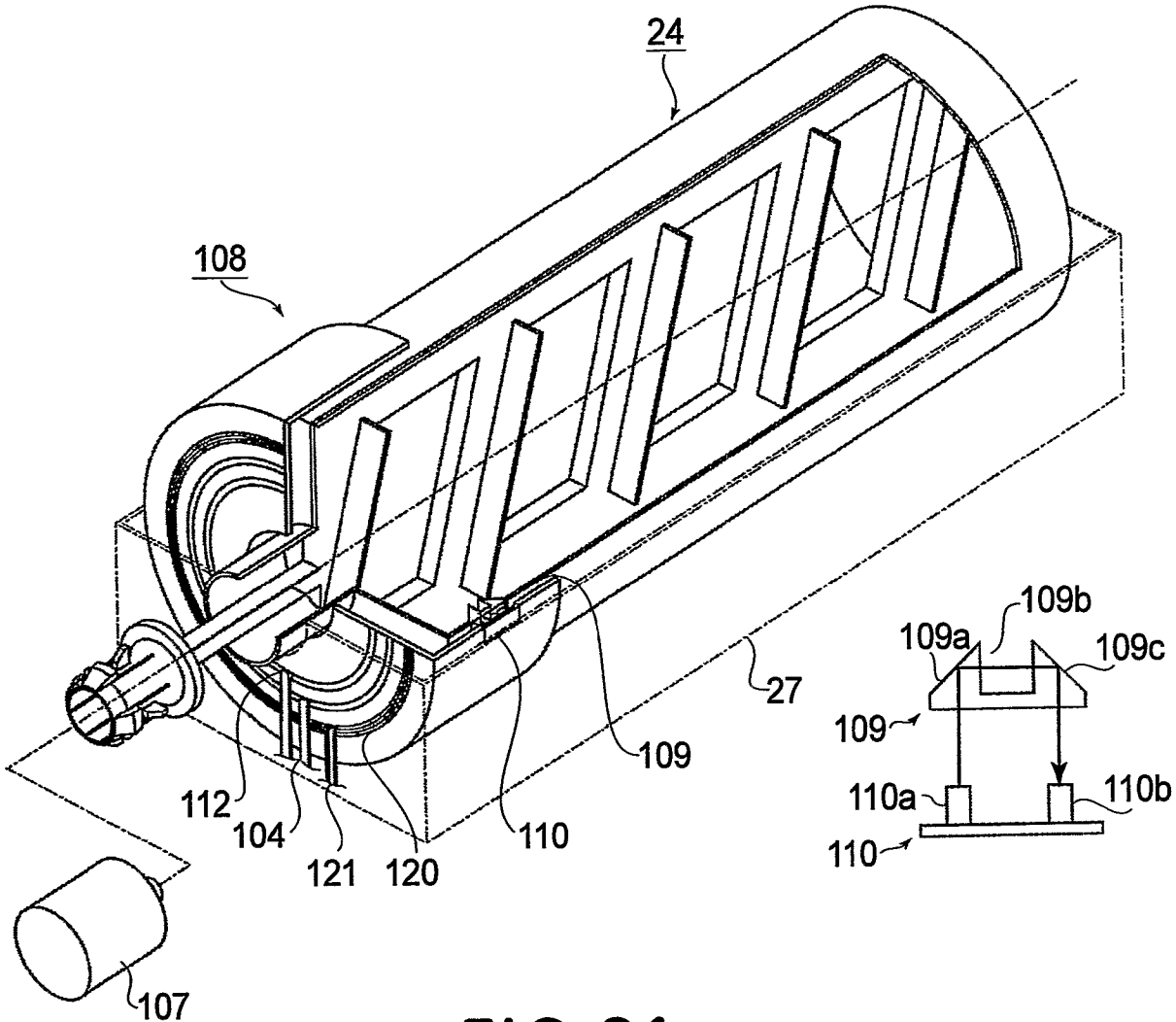
FIG. 21 is a schematic perspective cutaway view of the toner replenishing apparatus of the image forming apparatus, in the third embodiment of the present invention.
Figure 22:
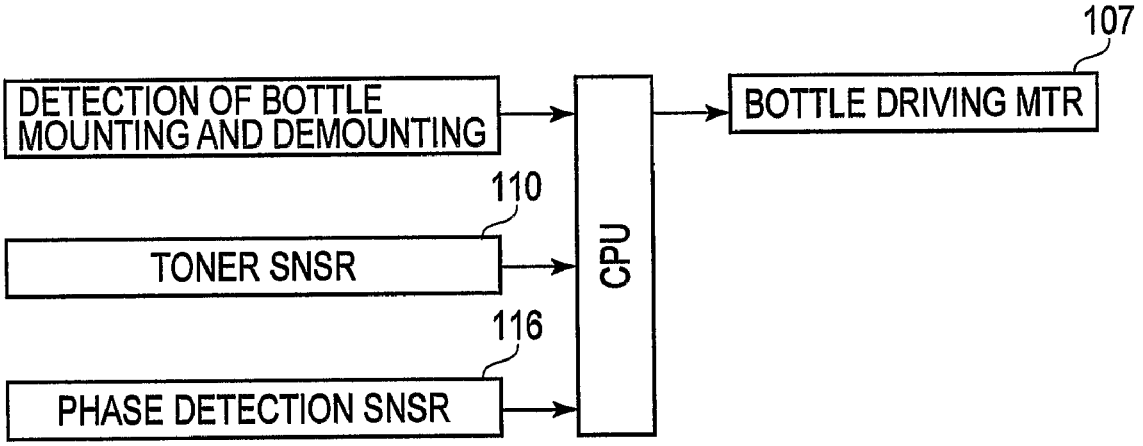
FIG. 22 is a block diagram of the operation for detecting the amount of the toner remainder in the replenishment toner bottle, in the third embodiment.
Figure 23:
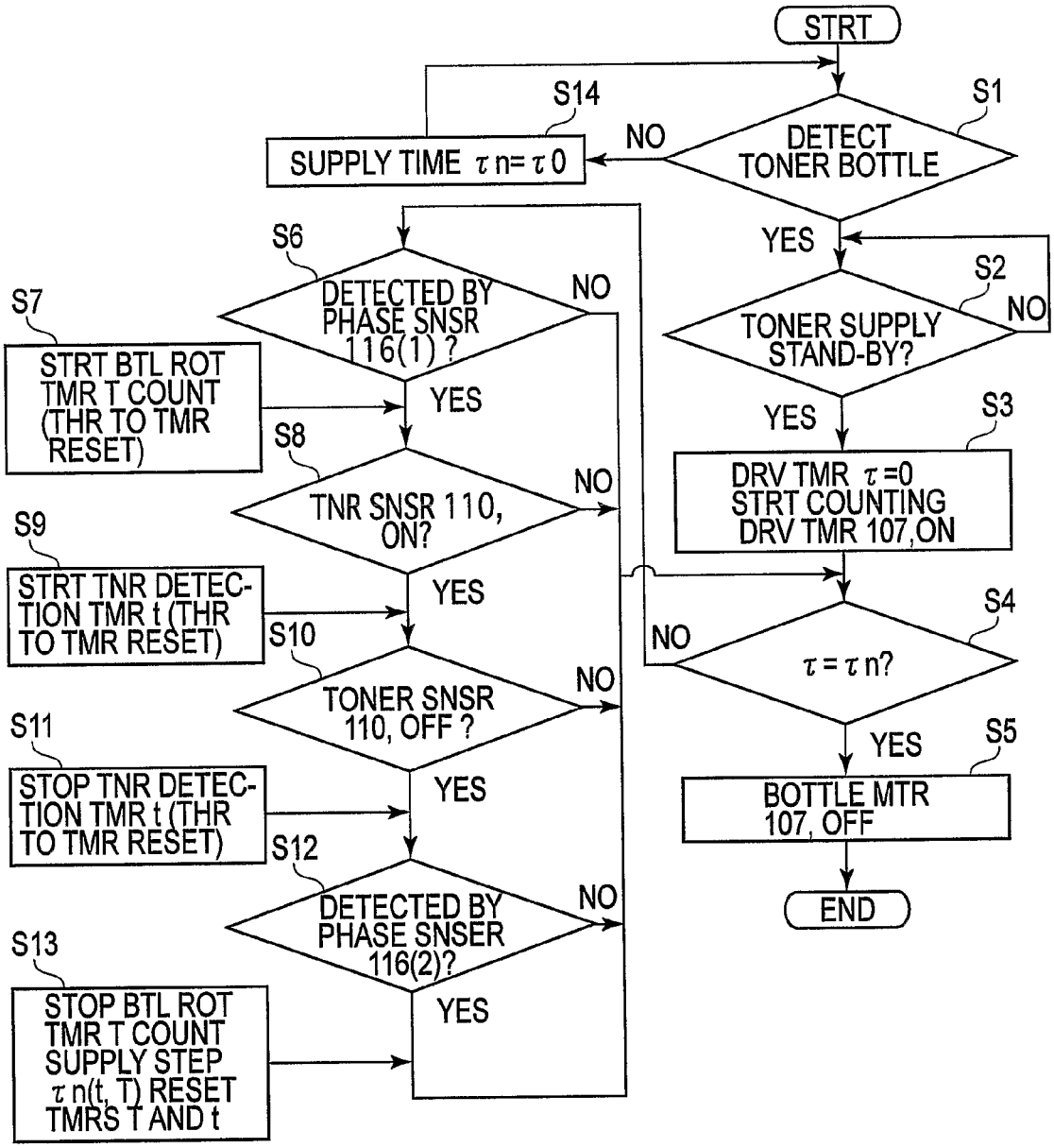
FIG. 23 is a flowchart of the combination of the operation for detecting the toner remainder amount and the operation for replenishing the developing device with the toner, in the third embodiment.

FIG. 21 is a schematic perspective view of the toner replenishing apparatus in this embodiment, and FIG. 22 is a block diagram of the operation for detecting the toner remainder in the toner bottle 24. FIG. 23 is a flowchart of the combination of the operation for detecting the amount of the toner remainder in the toner bottle 24, and the operation for replenishing the developing device with the toner from the toner bottle 24.

Figure 24:
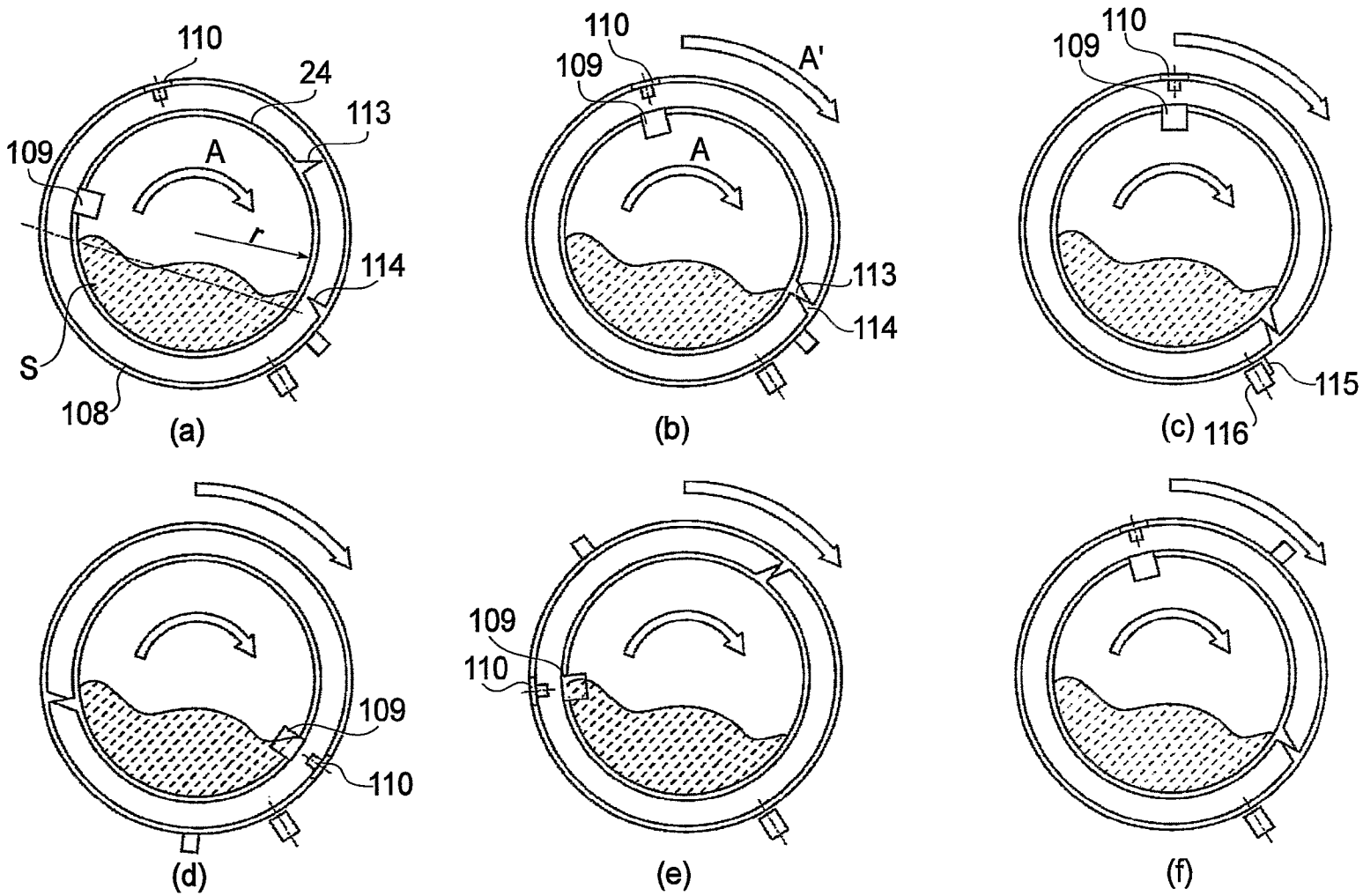
FIG. 24 is a schematic drawing for depicting the toner replenishing operation in the third embodiment.

Designated by a referential number 108 is a bottle socket as a rotational member rotatably supported by a bottle tray 27. Referring to FIG. 24, as the toner bottle 24 is rotated, the tooth 113 of the toner bottle 24 comes into contact with the driving force transmitting tooth 114 of the rotatable bottle socket 108. As a result, the bottle socket 108 is rotated by the rotation of the toner bottle 24.

The shapes of the coupling tooth 113 and driving force receiving tooth 114 do not need to be as shown in FIG. 24. That is, as long as they are such that the positional relationship between an optical prism 109 and a light sensor 110 is maintained (light sensor and optical prism remain optically connected) while the toner bottle 24 is rotated, the shapes of the teeth 113 and 114, etc., do not need to be as those in this embodiment.

The toner bottle 24 is provided with the optical prism 109 attached to an optical window through which the amount of the toner remainder in the toner bottle 24 is detected, whereas the rotational bottle socket 108 is provided with; the light sensor 110, as the means for detecting the toner remainder amount, which comprises a light emitting portion and a light receiving portion; a transmitting portion 120 for transmitting signals which reflect the detection of the presence or absence of the toner; and a slip ring 112 for supplying the toner sensor 110 with power.

The bottle tray 27 is provided with a power supply terminal 104, which is in contact with a slip ring 112, and a receiving portion 121 for receiving the signals reflecting the detected presence or absence of the toner.

The light sensor 110 has a light emitting portion 110*a* and a light receiving portion 110*b*, which are disposed so that regardless of the rotation of the toner bottle 24, the beam of light projected from the light emitting portion 110*a* is reflected by the reflective surfaces 109*a* and 109*b* of the optical prism 109, and reaches the light receiving portion 110*b*.

When toner is present in the toner presence (absence) detecting portion 109*b* of the optical prism 109, the beam of light does not reach the light receiving portion 110*b*, since it is blocked by the toner. Therefore, the CPU as a controlling apparatus determines that toner is present in the toner presence (absence) detecting portion 109*b*. On the other hand, when there is no toner in the toner presence (absence) detecting portion 109*b*, the beam of light reaches the light receiving portion 110*b*. Therefore, the CPU determines that there is no toner in the toner presence (absence) detecting portion 109*b*.

Also in this embodiment, the toner sensor 110 is desired to be attached to the external surface of the toner bottle 24, near the toner outlet 24*a*, or to the peripheral surface of the bottle proper 28 of the toner bottle 24, from the standpoint of the control of the detection of the toner remainder amount. In this embodiment, it is disposed on the peripheral surface of the toner proper 28 of the toner bottle 24.

Designated by a referential number 107 is a toner bottle motor for rotationally driving the toner bottle 24. The rotation of the toner bottle 24 is controlled by the CPU. More specifically, the length of time the toner bottle motor is to be driven to rotate the toner bottle 24 to replenish the developing device with the toner is computed by the CPU based on the bottle mounting/dismounting detection signal (unshown), information sent from the toner sensor 100 regarding the presence (absence) of the toner and rotational phase of the toner bottle 24.

FIGS. 24(*a*)-(*f*) show the general concept of how the amount of the toner remainder in the toner bottle 24 is detected. Next, the flowchart, in FIG. 23, of the combination of the operation for detecting the amount of the toner remainder and the operation for replenishing the developing device with the toner, will be described in conjunction with the drawings in FIG. 24.

As a toner replenishment request is generated by the image forming portion, the toner replenishment operation is started. When the toner bottle 24 is already in the bottle tray 27, the value obtained by the immediately preceding computation is used as the length of replenishment time $\tau n$ per toner replenishment operation. Whereas when there is no toner bottle 24 in the bottle tray 27, the following steps are taken: As a toner bottle is placed in the 25 bottle tray 27, the replenishment time $\tau n$ is set to the initial value $\tau 0$ (Step 1). Referring to FIG. 24(*a*), it should be noted here that immediately after the placement of the toner bottle 24 in the bottle tray 27, the optical prism 109 of the toner bottle 24 and the light sensor 110 of the rotational bottle socket 108 are not always coincidental in rotational phase.

As the toner replenishment becomes possible (Step 2), a timer ($\tau$) for counting the length of the replenishment time the toner bottle motor is driven for toner replenishment is set to zero, and the toner bottle motor 107 is activated to rotate the toner bottle 24 in the direction indicated by an arrow mark A in order to replenish the developing device with the toner, as shown in FIG. 24(*a*), with the counting of the length of the replenishment time being started at the same time.

Referring to FIG. 24(*b*), at roughly the same time as the optical prism 109 and light sensor 110 become coincidental in rotational phase, the coupling tooth 113 of the toner bottle 24 engages with the driving force transmitting tooth 114, causing the rotational bottle socket 108 to rotate in the direction indicated by an arrow mark A' (bottle socket 108 is rotated by rotation of toner bottle 24) (Step 3).

Referring to FIG. 24(*c*), as the toner bottle 24 and bottle socket 108 rotate together, a phase detection flag 115 attached to the bottle socket 108 is detected by a phase detection sensor 116 (Step 6). That is, it is detected that the positional relationship between the optical prism 109 and light sensor 110 becomes such that the amount of the toner remainder in the toner bottle 24 can be detected. The signal that signals this detection will be referred to as first phase detection signal (1).

As soon as the phase detection flag 115 is detected by the phase detection sensor 116, that is, at the same time as the first phase detection signal (1) is outputted, a timer T for counting the length of time the toner sensor 100 keeps on signalling the presence of the toner during the following single full rotation of the toner bottle 24, that is, between when the first phase detection signal (1) is outputted and when the phase detection flag 115 is detected by the phase detection sensor 116 for the second time, that is, when the second phase detection signal (2) is outputted (Step 7).

Referring to FIG. 24(*d*), as the toner is detected by the toner sensor 110 (Step 8), the timer t for counting the length of time the toner bottle motor is driven during the period between when the presence of the toner is detected and when the absence of the toner is detected (Step 9). The toner bottle 24 is rotated in the direction indicated by an arrow mark A. As the absence of the toner is detected by the toner sensor 110 when the toner sensor 110 is at the point shown in FIG. 24(*e*) (Step 10), the timer t is stopped (Step 11). The toner bottle 24 is further rotated to continue the toner replenishment. Then, as the phase detection flag 115 is detected by the phase detection sensor 116 for the second time as shown in FIG. 24(*f*) (Step 12), the bottle rotation timer T is stopped, and the length of toner replenishment time γn is computed by the CPU based on the value in the timer t and value in the timer T, and the value obtained by the immediately preceding computation is replaced by the freshly obtained value (Step 13).

The toner bottle 24 is further rotated in the arrow mark A direction until the value in the time t for counting the length of time the bottle motor 107 is rotated reaches the new value γn for the length of the replenishment time τ, while the process of replenishing the developing device with the toner from the toner bottle 24, the process of detecting the amount of the toner remainder in the toner bottle 24, and the process of computing the length of time for toner replenishment, are repeated (Step 4). Then, as the value in timer t reaches the value γn, the bottle motor 107 is stopped (Step 5).

Figure 25:
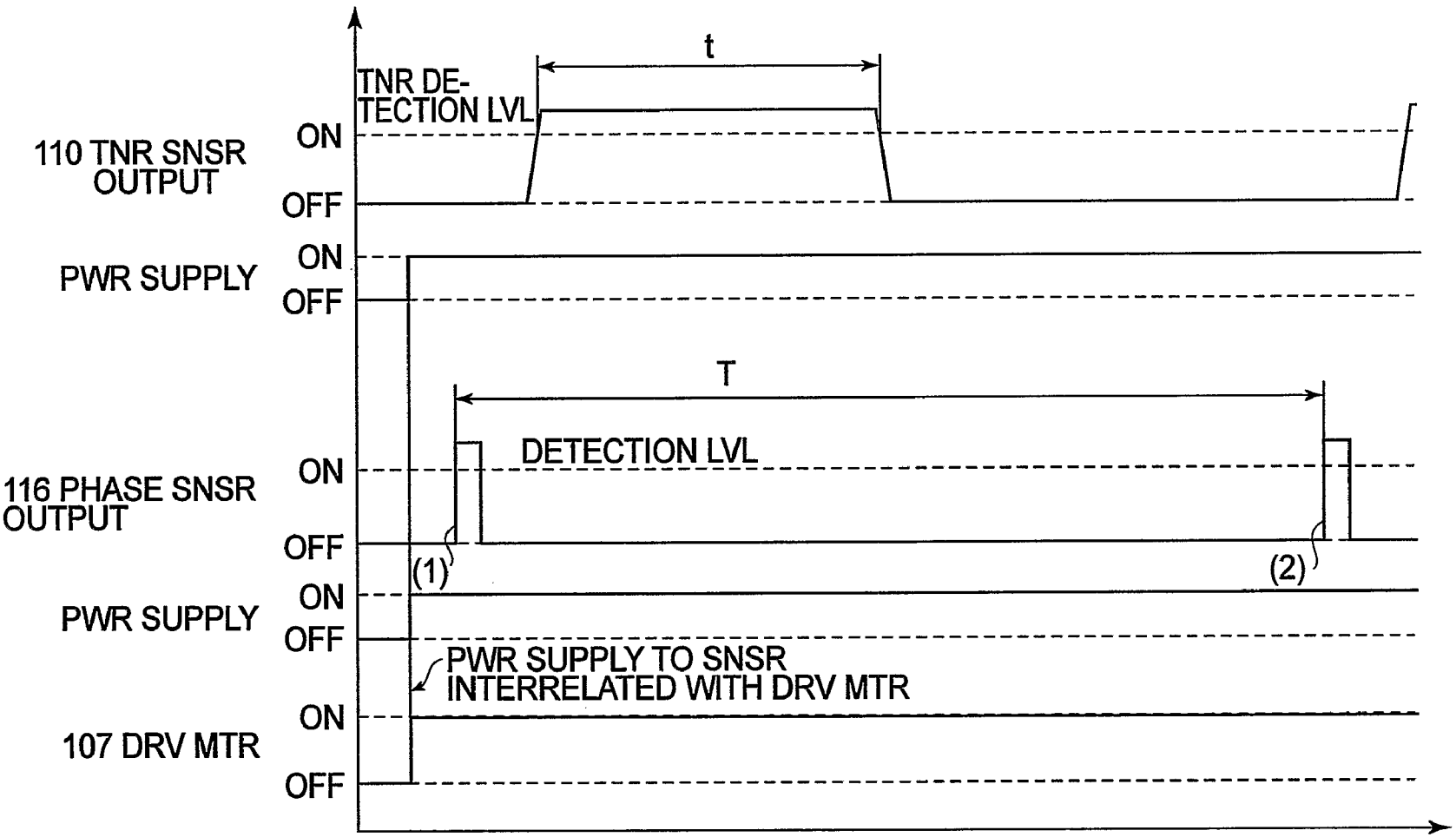
FIG. 25 is a diagram for showing the faculties of the various sensors involved in the toner replenishing operation, in the third embodiment.
Figure 26:
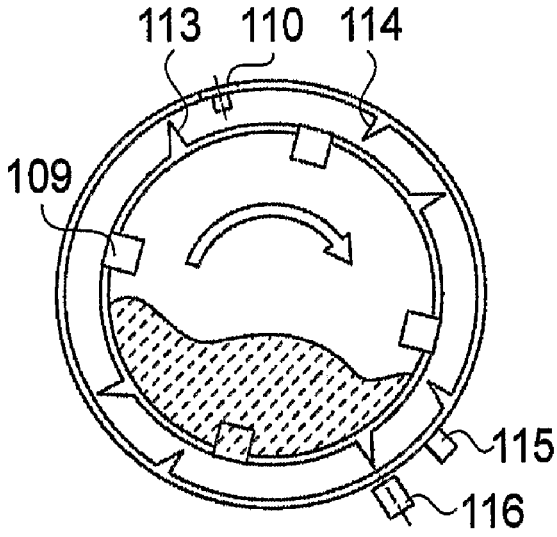
FIG. 26 is a schematic sectional view of the replenishment toner container similar to the one in the third embodiment, showing the general structure thereof.
Figure 27:
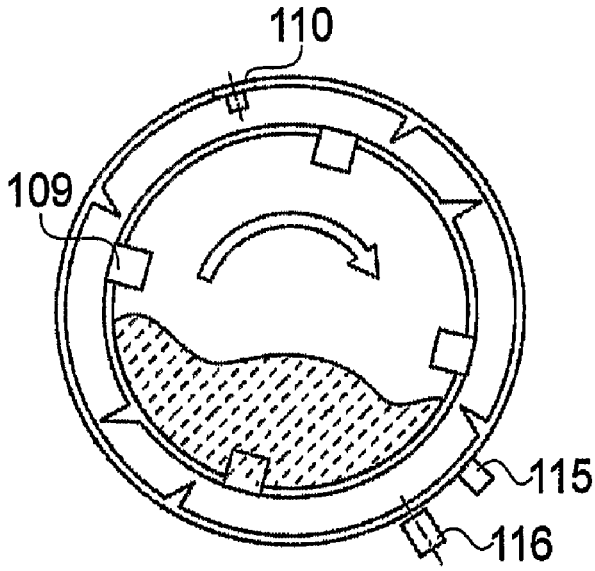
FIG. 27 is a schematic sectional view of another replenishment toner container similar to the one in the third embodiment, showing the general structure thereof.
Figure 28:
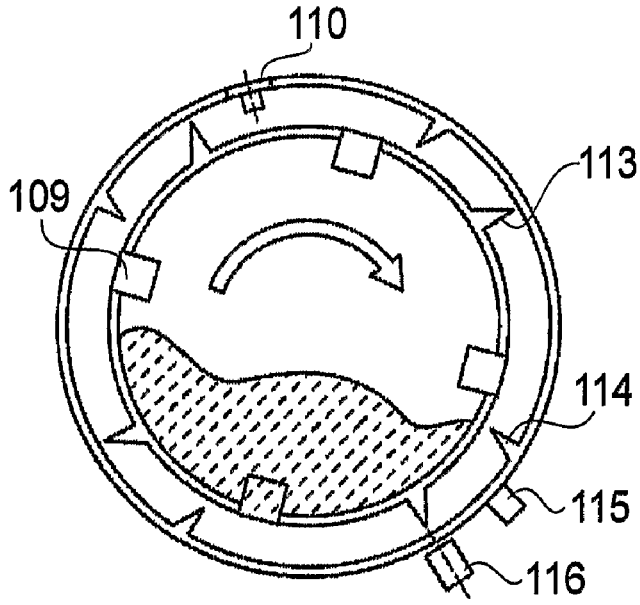
FIG. 28 is a schematic sectional view of another replenishment toner container similar to the one in the third embodiment, showing the general structure thereof.

FIG. 25 is a diagram showing the changes in the signals outputted by the toner sensor 110 and phase detection sensors during the operation shown in FIG. 24. It shows that the presence (absence) of the toner is detected by the toner sensor 110 during the period between when the first phase detection signal (1) is outputted and when the second phase detection signal (2) is outputted.

In the following, T stands for the length of time the presence (absence) of the toner is detected, that is, the length of time between when the first phase detection signal (1) is outputted and when the second phase detection signal (2) is outputted, and t stands for the length of time the presence of the toner is detected by the toner sensor 110.

When the internal diameter of the toner bottle 24 is r, the cross-sectional area S of the body of the toner in the toner bottle 24 shown in FIG. 14 can be expressed by the following approximation.

$$S = r^2\left(\frac{\pi t}{T} - \cos\left(\frac{\pi t}{T}\right)\sin\left(\frac{\pi t}{T}\right)\right)$$

When the length of the toner bottle 24 is L, and the correction factor dependent on the cross sectional area S of the body of the toner, perpendicular to the lengthwise direction of the toner bottle 24, is a(S), the volume V of the toner remaining in the toner bottle 24 can be expressed by the following approximation, as accurately as in the first embodiment, by detecting the presence (absence) of the toner with the employment of the above-described structural arrangement and controlling method.

$$V=\alpha(S)\grave{u}S\grave{u}L$$

Similarly, the amount ΔVn by which the toner is to be discharged from the toner bottle 24 per rotational movement thereof between the (n−1)-th detection of the toner remainder amount and n-th detection, and the average value of the amount ΔVn by which the toner is discharged from the toner bottle 24 m times between the (n-m)-th detection of the toner remainder amount and m-th detection, can be obtained from the following approximations.

$$\Delta Vn = \alpha(S)\grave{u}(S_{n-1} - Sn)_\mathrm{L}$$

$$\Delta\overline{V}_n = \frac{\alpha(S)\cdot(S_{n-m} - S_n)L}{m}$$

Thus, the length τn of the toner replenishment time per toner replenishment operation is controlled so that ΔVn/γn always remains constant.

$$\frac{\Delta V_n}{\tau_n} = Const.$$

$$\frac{\Delta\overline{V}_n}{\tau_n} = Const.$$

With the employment of the above-described structural arrangement and control, it is possible to stabilize the amount by which the toner is discharged for the replenishment of the developing device with the toner, regardless of the amount of the toner remainder in the toner bottle 24.

In this embodiment, the toner bottle 24 is provided with a single coupling tooth 113, and the rotational bottle socket 108 is provided with a single driving force transmission tooth 114. However, the toner bottle 24 and rotational bottle socket 108 may be provided with a plurality of coupling teeth 113 and a plurality of driving force transmission teeth 114, respectively, while providing the toner bottle 24 with the same number of optical prisms 109 as the number of the coupling teeth 113 (driving force transmission teeth 114). With the employment of this structural arrangement, it is possible to reduce the length of time between the setting of the toner bottle 24 in the bottle tray 27 and the engagement of the coupling teeth 113 with driving force transmission teeth 114.

Figure 29:
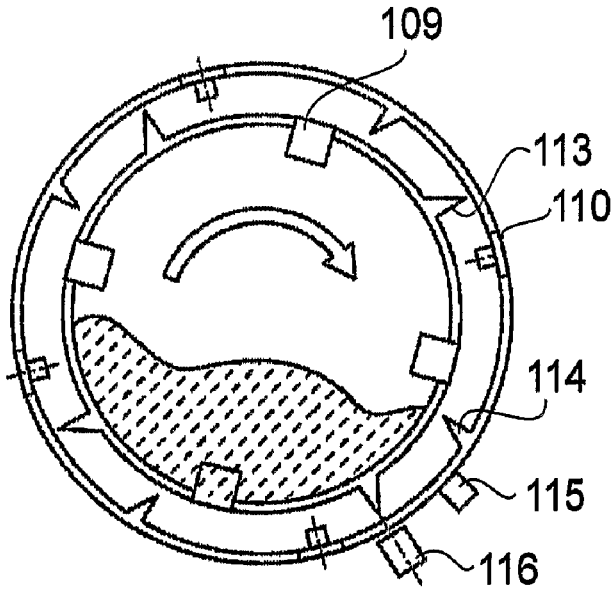
FIG. 29 is a schematic sectional view of another replenishment toner container similar to the one in the third embodiment, showing the general structure thereof.

The length of time between the setting of the toner bottle 24 in the bottle tray 27 and the engagement of the coupling teeth 113 with driving force transmission teeth 114 can also be reduced with the employment of a plurality of light sensors 110 disposed as shown in FIG. 29.

Figure 30:
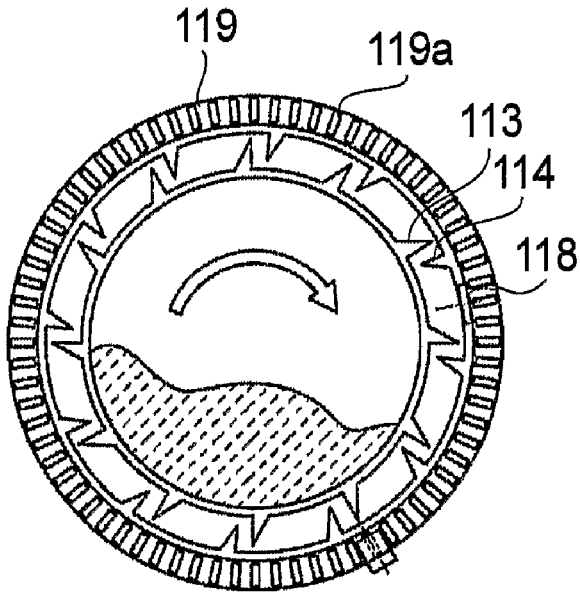
FIG. 30 is a schematic sectional view of another replenishment toner container similar to the one in the third embodiment, showing the general structure thereof.

Referring to FIG. 30, when magnetic toner is used, a magnetic sensor 118 of the magnetic permeability detection type can be used. Therefore, it is unnecessary to synchronize the toner bottle 24 and rotational bottle socket 108 in rotational phase. Therefore, the toner bottle 24 and rotational bottle socket 108 may be provided with as many coupling teeth 113 and driving force transmission teeth 114, respectively, as desired, in order to further reduce the time it take for the coupling teeth 113 to engage with the driving force transmission teeth 114, one for one.

Further, with the employment of such a method that detects the rotational phase of the toner bottle 24 with the use of the combination of a rotational phase detection plate 119 having a plurality of holes 119*a* and a rotational phase detection sensor 116, the amount of the toner remainder in the toner bottle 24 can be detected before the first rotation of the toner bottle 24 ends, as it is in the first embodiment.

Figure 31:
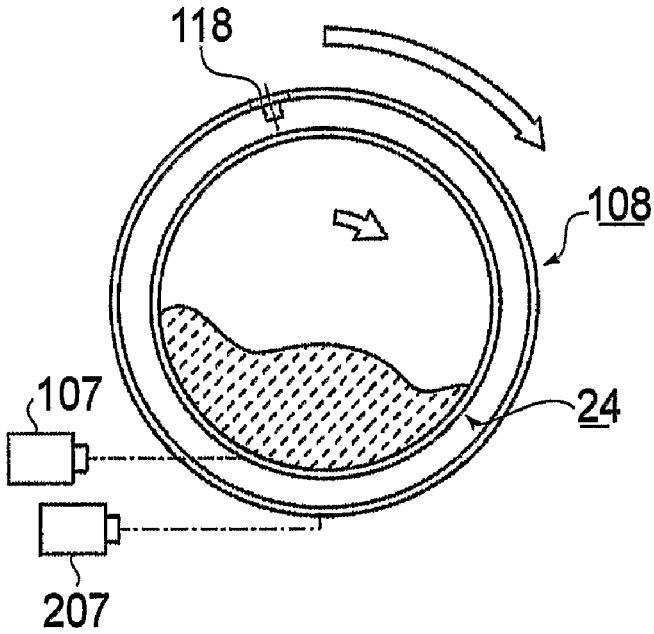
FIG. 31 is a schematic sectional view of another replenishment toner container similar to the one in the third embodiment, showing the general structure thereof.

FIG. 31 shows a structural arrangement in which the bottle proper 28 and rotational bottle socket 108 rotate together, and further, the bottle proper 28 and rotational bottle socket 108 are individually driven by motors 107 and 207, respectively, so that the rotational bottle socket 108 can be rotated at a higher velocity than the bottle proper 28, in order to reduce the time it takes to detect the amount of the toner remainder.

Further, providing the bottle proper 28 and rotational bottle socket 103 with their own motors 107 and 207, respectively, as shown in FIG. 31, makes it possible to detect the amount of the toner remainder even while the toner replenishment operation is not carried out.

Figure 32:
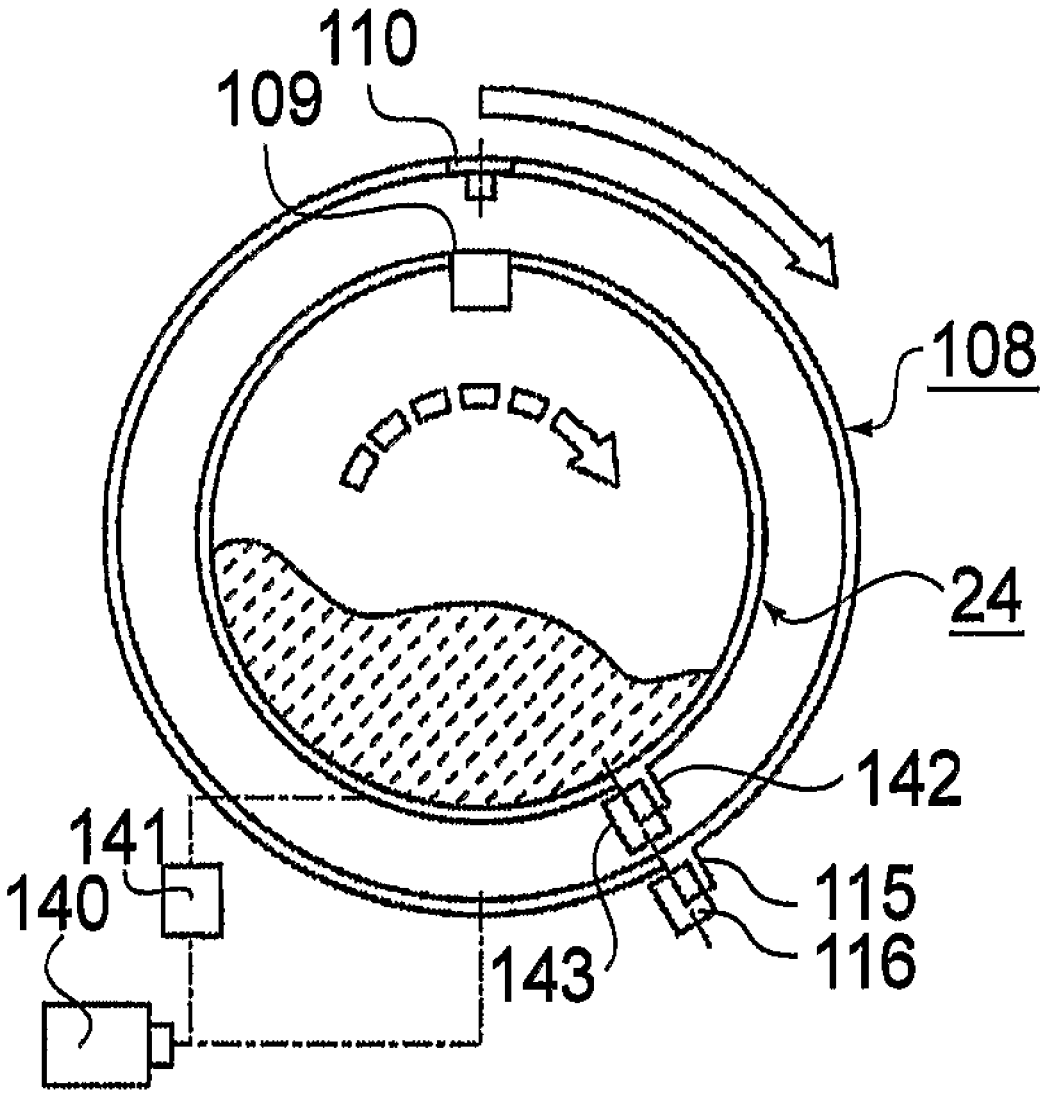
FIG. 32 is a schematic sectional view of another replenishment toner container similar to the one in the third embodiment, showing the general structure thereof.

In the case of the structural arrangement shown in FIG. 32, the driving force from the motor 140 is directly transmitted to the rotational bottle socket 108, whereas to the toner bottle 24, it is transmitted through a clutch 141. Further, the toner bottle 24 is provided with a phase detection flag 142, and the rotational phase of the toner bottle 24 is detected by the sensor 143 for detecting the rotational phase of the toner bottle 24. Further, the rotational phase detection flags 142 and 115 of the toner bottle 24 and rotational bottle socket 108 are positioned so that at the same time as they are detected by the phase detection sensors 143 and 116, respectively, the optical prism 109 and light sensor 110 become coincidental in terms of rotational phase.

As the toner bottle 24 is set in the main assembly of the image forming apparatus 1, the clutch 141 is connected, and motor 140 is rotated. Then, as the rotational phase sensor 143 is detected, the clutch 141 is disconnected, and therefore, the toner bottle 24 stops rotating. Thereafter, as the rotational phase detection sensor 116 is detected, the clutch 141 is connected again, causing the toner bottle 24 and rotational bottle socket 108 to rotate in synchronism to detect the amount of the toner remainder in the toner bottle 24.

Therefore, the rotation of the toner bottle 24 between the setting the toner bottle 24 in the main assembly of the image forming apparatus 1 and the synchronization of the optical prism 109 and light sensor 110 in rotational phase can be minimized.

Figure 33:
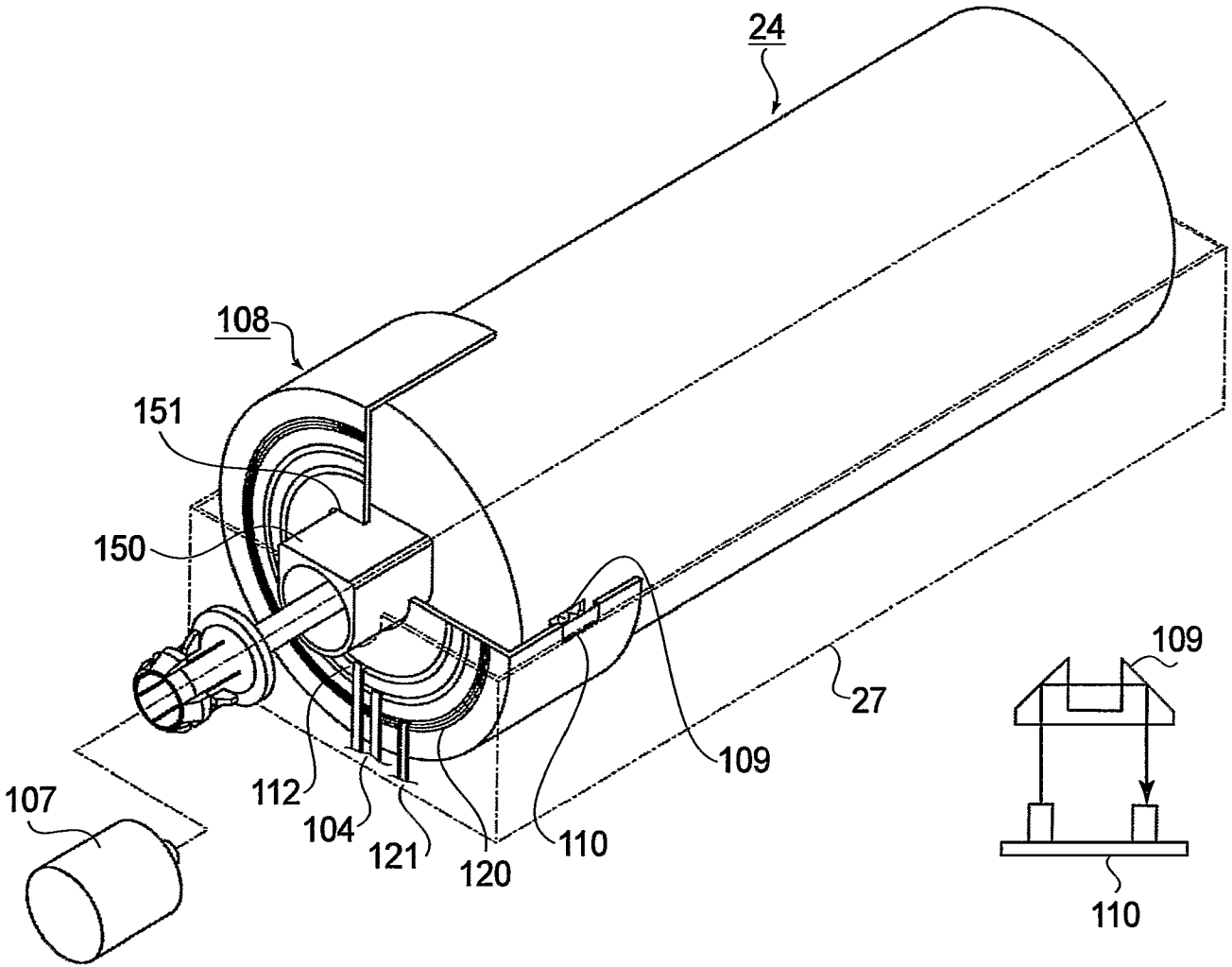
FIG. 33 is a schematic perspective cutaway view of another replenishment toner container similar to the one in the third embodiment, showing the general structure thereof.

In the case of the structural arrangement shown in FIG. 33, the toner bottle 24 is provided with a transmitting portion 150 for transmitting driving force to the toner bottle 24, and the rotational bottle socket 108 is provided with a driving force receiving portion 151. Further, the transmitting portion 150 and driving force receiving portion 151 are engaged by the operation for setting the toner bottle 24 in the main assembly of the image forming apparatus 1. With the provision of this structural arrangement, as soon as the toner bottle 24 is set in the image forming apparatus 1, the process of engaging the toner bottle 24 with the bottle socket 108, and process of synchronizing the optical prism 109 and light sensor 110 in rotational phase, are carried out, improving thereby the image forming apparatus in operability.

With the employment of the above-described structural arrangement, it is assured that the amount of the toner remainder in the toner bottle 24 is accurately and continually detected. Therefore, not only is it possible to inform a user of the need of toner bottle replacement, at a more opportune time, but also, to enable a user to schedule the times for ordering or replacing the toner bottle 24, according to the user's own convenience. Therefore, it is possible to substantially reduce the space necessary for storing the replacement toner bottles, and the downtime of an image forming apparatus. In other words, the employment of the above-described structural arrangement can drastically improve an image forming apparatus in usability.

Also with the employment of the above-described structural arrangement, it becomes possible to stabilize the amount by which the developing device is replenished with the toner from the toner bottle 24. Therefore, it is possible to simplify in function, or eliminate, the hopper portion which is for temporarily storing the toner discharged from the toner bottle 24 to ensure that the developing device is continuously replenished with a stable amount of toner. Further, the function of the hopper portion, as a temporary toner storage portion for ensuring that a substantial number of copies can be made even after the detection of the complete depletion of the toner in the toner bottle 24, becomes unnecessary. In other words, the hopper portion itself becomes unnecessary. Thus, the above-described structural arrangement makes it possible to further simplify, and reduce in size, the main assembly of an image forming apparatus.

In the above, the first to third embodiments of the present invention were described with reference to the toner bottle 24, which is cylindrical. However, the shape of the toner bottle 24 does not need to be limited to the cylindrical one; it may be any shape.

As described above, according to the above-described first to third embodiments of the present invention, it is possible to prevent an image forming apparatus from increasing in cost, and also, from becoming complicated in structure.

Also according to the first to third embodiments, it is possible to precisely detect the amount of the toner remainder in a replenishment toner bottle. Therefore, it is possible to inform a user of the accurate amount of the toner remainder. In other words, it is possible to inform a user of an opportune timing with which a replenishment toner bottle to be replaced.

INDUSTRIAL APPLICABILITY

According to the present invention, it is possible to minimize the space necessary for storing the replacement toner bottles, and substantially reduce the downtime of an image forming apparatus attributable to the problem that the toner bottle 24 runs out of the toner. In other words, it is possible to drastically improve an image forming apparatus in usability.

While the invention has been described with reference to the structures disclosed herein, it is not confined to the details set forth, and this application is intended to cover such modifications or changes as may come within the purposes of the improvements or the scope of the following claims.

The invention claimed is:

1. A toner supply container comprising:

a rotatable container body having a toner containable inner space and an opening configured and positioned to permit discharge of the toner in said container body;

a driving force receiving portion configured and positioned to receive a rotational driving force for rotating said container body;

a toner feeding portion configured and positioned to feed the toner in said container body toward said opening with rotation of said container body; and a sensor provided on said container body so as to rotate integrally with said container body and configured to output a signal varying in accordance with the rotation of said container body and a remaining toner amount of said container body.

2. A toner supply container according to claim 1, further comprising a sending portion configured and positioned to send information corresponding to the signal outputted by said sensor.

3. A toner supply container according to claim 2, wherein said sending portion sends the information wirelessly.

4. A toner supply container according to claim 2, wherein said sensor outputs an electrical signal as the signal.

5. A toner supply container according to claim 4, wherein said sensor and said sending portion are provided integrally on a common substrate.

6. A toner supply container according to claim 1, wherein said sensor is fixed on a peripheral portion of said container body.

7. A toner supply container according to claim 1, wherein said sensor is fixed at a position which is remote from an axis of said container body on an axial end surface of said container body.

8. A toner supply container according to claim 1, further comprising an electrical contact portion configured and positioned to receive electric energy for driving said sensor.

9. A toner supply container according to claim 1, wherein said sensor is a pressure sensor.

10. A toner supply container according to claim 1, wherein said sensor is a magnetic sensor.

11. A toner supply container according to claim 1, wherein said opening is provided adjacent to one axial end portion of said container body, and said sensor is provided at a position closer to said opening than the other axial end portion of said container body.

12. A toner supply container according to claim 1, wherein said toner feeding portion is a spiral groove formed on said container body.

13. A toner supply system comprising:

a toner supply container; and a toner supply apparatus to which said toner supply container is detachably mountable, wherein said toner supply container includes:

a rotatable container body having a toner containable inner space and an opening configured and positioned to permit discharge of the toner in said container body;

a driving force receiving portion configured and positioned to receive a rotational driving force for rotating said container body;

a toner feeding portion configured and positioned to feed the toner in said container body toward said opening with rotation of said container body; and a sensor provided on said container body so as to rotate integrally with said container body and configured to output a signal varying in accordance with the rotation of said container body and a remaining toner amount of said container body, and wherein said toner supply apparatus includes:

a driving portion configured and positioned to apply the rotational driving force to said driving force receiving portion; and a notification portion configured and positioned to notify of information corresponding to the remaining toner amount in said container body using the signal outputted by said sensor.

14. A toner supply system according to claim 13, wherein said toner supply container further includes a sending portion configured and positioned to send information corresponding to the signal outputted by said sensor.

15. A toner supply system according to claim 14, wherein said sending portion sends the information wirelessly.

16. A toner supply system according to claim 14, wherein said sensor outputs an electrical signal as the signal.

17. A toner supply system according to any one of claims 14, 15, and 16, wherein said toner supply apparatus further includes a receiving portion configured and positioned to receive information sent by said sending portion.

18. A toner supply system according to claim 14, wherein said sensor and said sending portion are provided integrally on a common substrate.

19. A toner supply system according to claim 13, wherein said notification portion includes a displaying device configured and positioned to display information corresponding to the remaining toner amount in said container body.

20. A toner supply system according to claim 13, wherein said sensor is fixed on a peripheral portion of said container body.

21. A toner supply system according to claim 13, wherein said sensor is fixed at a position which is remote from an axis of said container body on an axial end surface of said container body.

22. A toner supply system according to claim 13, wherein said toner supply container includes an electrical contact portion configured and positioned to receive electric energy for driving said sensor by slidably contacting with an electric contact portion provided in said toner supply apparatus.

23. A toner supply system according to claim 13, wherein said sensor is a pressure sensor.

24. A toner supply system according to claim 13, wherein said sensor is a magnetic sensor.

25. A toner supply system according to claim 13, wherein said opening is provided adjacent to one axial end portion of said container body, and said sensor is provided at a position closer to said opening than the other axial end portion of said container body.

26. A toner supply system according to claim 13, wherein said toner feeding portion is a spiral groove formed on said container body.

27. A toner supply container comprising:

a rotatable container body having a toner containable inner space;

a driving force receiving portion configured and positioned to receive a rotational driving force for rotating said container body about an axis to discharge the toner out of said container body; and a sensor provided at a position radially remote from the axis so as to rotate around the toner contained in said container body with rotation of said container body and configured to output a signal varying in accordance with the rotation of said container body and a remaining toner amount of said container body.

28. A toner supply container according to claim 27, further comprising a sending portion configured and positioned to send information corresponding to the signal outputted by said sensor.

29. A toner supply container according to claim 28, wherein said sending portion sends the information wirelessly.

30. A toner supply container according to claim 28, wherein said sensor outputs an electrical signal as the signal.

31. A toner supply container according to claim 30, wherein said sensor and said sending portion are provided integrally on a common substrate.

32. A toner supply container according to claim 27, wherein said container body includes an opening provided on one axial end portion of said container body and configured to permit discharge of the toner in said container body, and wherein said toner supply container further includes a toner feeding portion configured and positioned to feed the toner toward said opening with the rotation of said container body.

33. A toner supply container according to claim 32, wherein said sensor is provided at a position closer to said opening than the other axial end portion of said container body.

34. A toner supply container according to claim 32 or 33, wherein said toner feeding portion is a spiral groove formed on said container body.

35. A toner supply container according to claim 27, further comprising an electrical contact portion configured and positioned to receive electric energy for driving said sensor.

36. A toner supply container according to claim 27, wherein said sensor is provided on a cylindrical portion of said container body.

37. A toner supply container according to claim 36, wherein said sensor is provided on an outer surface of said container body.

38. A toner supply container according to claim 27, wherein said sensor is provided on a peripheral portion of said container body.

39. A toner supply container according to claim 38, wherein said sensor is provided on an outer surface of said container body.

40. A toner supply container according to claim 27, wherein said sensor is provided on an axial end of said container body.

41. A toner supply container according to claim 40, wherein said sensor is provided on an outer surface of said container body.

42. A toner supply container according to claim 27, wherein said sensor is a pressure sensor.

43. A toner supply container according to claim 27, wherein said sensor is a magnetic sensor.

44. A toner supply container comprising:

a rotatable container body having a toner containable inner space;

a driving force receiving portion configured and positioned to receive a rotational driving force for rotating said container body to discharge the toner out of said container body; and a sensor provided so as to be rotatable integrally with said container body while changing a positional relationship with the toner contained in said container body with rotation of said container body and configured to output a signal varying in accordance with the rotation of said container body and a remaining toner amount of said container body.

45. A toner supply container according to claim 44, further comprising a sending portion configured and positioned to send information corresponding to the signal outputted by said sensor.

46. A toner supply container according to claim 45, wherein said sending portion sends the information wirelessly.

47. A toner supply container according to claim 45, wherein said sensor outputs an electrical signal as the signal.

48. A toner supply container according to claim 47, wherein said sensor and said sending portion are provided integrally on a common substrate.

49. A toner supply container according to claim 44, wherein said container body includes an opening provided adjacent to one axial end portion of said container body and configured to permit discharge of the toner in said container body, and wherein said toner supply container further includes a toner feeding portion configured and positioned to feed the toner toward said opening with the rotation of said container body.

50. A toner supply container according to claim 49, wherein said sensor is provided at a position closer to said opening than the other axial end portion of said container body.

51. A toner supply container according to claim 49 or 50, wherein said toner feeding portion is a spiral groove formed on said container body.

52. A toner supply container according to claim 44, further comprising an electrical contact portion configured and positioned to receive electric energy for driving said sensor.

53. A toner supply container according to claim 44, wherein said sensor is provided on a cylindrical portion of said container body.

54. A toner supply container according to claim 53, wherein said sensor is provided on an outer surface of said container body.

55. A toner supply container according to claim 44, wherein said sensor is provided on a peripheral portion of said container body.

56. A toner supply container according to claim 55, wherein said sensor is provided on an outer surface of said container body.

57. A toner supply container according to claim 44, wherein said sensor is provided on an axial end of said container body.

58. A toner supply container according to claim 57, wherein said sensor is provided on an outer surface of said container body.

59. A toner supply container according to claim 44, wherein said sensor is a pressure sensor.

60. A toner supply container according to claim 44, wherein said sensor is a magnetic sensor.

* * * * *